US005581285A

United States Patent [19]

Watanabe et al.

[11] Patent Number: 5,581,285

[45] Date of Patent: Dec. 3, 1996

[54] INK JET RECORDING HEAD WITH DISCHARGE OPENING SURFACE TREATMENT

[75] Inventors: Takashi Watanabe, Hiratsuka; Kazuaki Masuda, Sagamihara; Akihiko Shimomura, Atsugi; Akio Saito, Yamato; Toshio Kashino, Chigasaki; Masami Kasamoto, Ayase, all of Japan

[73] Assignee: Canon Kabushiki Kaisha, Tokyo, Japan

[21] Appl. No.: 460,553

[22] Filed: Jun. 2, 1995

Related U.S. Application Data

[63] Continuation of Ser. No. 361,453, Dec. 21, 1994, abandoned, which is a continuation of Ser. No. 879,466, May 4, 1992, abandoned, which is a continuation of Ser. No. 758,305, Aug. 28, 1991, abandoned, which is a continuation of Ser. No. 622,140, Dec. 4, 1990, abandoned, which is a continuation of Ser. No. 351,878, May 15, 1989, abandoned.

[30] Foreign Application Priority Data

| | | | |
|---|---|---|---|
| May 20, 1988 | [JP] | Japan | 63-122040 |
| May 13, 1988 | [JP] | Japan | 63-114806 |
| May 13, 1988 | [JP] | Japan | 63-114807 |
| May 13, 1988 | [JP] | Japan | 63-114808 |
| May 13, 1988 | [JP] | Japan | 63-114809 |
| May 13, 1988 | [JP] | Japan | 63-114810 |
| May 12, 1989 | [JP] | Japan | 1-117496 |

[51] Int. Cl.[6] ..... B41J 2/14

[52] U.S. Cl. ..... 347/45; 347/47

[58] Field of Search ..... 347/45, 47

[56] References Cited

U.S. PATENT DOCUMENTS

| | | | |
|---|---|---|---|
| 2,747,541 | 5/1956 | Chew . | |
| 3,366,091 | 1/1968 | Mull . | |
| 3,371,001 | 2/1968 | Ettre . | |
| 3,941,312 | 3/1976 | Ohno et al. . | |
| 4,251,824 | 2/1981 | Hara et al. . | |
| 4,296,421 | 10/1981 | Hara et al. . | |
| 4,330,787 | 5/1982 | Sato et al. . | |
| 4,368,476 | 1/1983 | Uehara | 347/45 |
| 4,376,945 | 3/1983 | Hara et al. . | |
| 4,417,251 | 11/1983 | Sugitani . | |
| 4,420,764 | 12/1983 | Okada . | |
| 4,450,455 | 5/1984 | Sugitani | 347/45 |
| 4,459,600 | 7/1984 | Sato et al. . | |
| 4,463,359 | 7/1984 | Ayata et al. . | |
| 4,492,966 | 1/1985 | Seki et al. . | |
| 4,499,480 | 2/1985 | Takatori | 347/56 |
| 4,520,373 | 5/1985 | Ayata et al. . | |
| 4,623,906 | 11/1986 | Chandrashekhar et al. . | |
| 4,701,766 | 10/1987 | Sugitani et al. . | |
| 4,707,705 | 11/1987 | Hara et al. . | |
| 5,005,024 | 4/1991 | Takahashi et al. | 347/45 |
| 5,148,193 | 9/1992 | Inamoto | 347/45 |

FOREIGN PATENT DOCUMENTS

| | | | |
|---|---|---|---|
| 0268213 | 5/1988 | European Pat. Off. . | |
| 268213 | 5/1988 | European Pat. Off. | B41J 3/04 |
| 2439073 | 5/1980 | France | B29C 27/14 |
| 57-157764 | 9/1982 | Japan | B41J 3/04 |
| 59-176054 | 10/1984 | Japan | B41J 3/04 |
| 184852 | 9/1985 | Japan | B41J 3/04 |
| 92852 | 4/1987 | Japan | B41J 3/04 |
| WO82/01414 | 4/1982 | WIPO | B41J 3/04 |

OTHER PUBLICATIONS

Quaca, Ahn; Ink Jet Cleaning, Xerox Disclosure Journal, vol. 7, No. 5, Sep./Oct. 1982, p. 323.

*Primary Examiner*—Joseph W. Hartary

*Attorney, Agent, or Firm*—Fitzpatrick, Cella, Harper & Scinto

[57] ABSTRACT

An ink jet recording head for discharging liquid and recording on a recording medium includes a substrate having a liquid path, and a discharge opening provided on a surface of the substrate and communicating with the liquid path. Plurality raised surface irregularities are formed on the surface of the substrate having the discharge opening. The surface irregularities are disposed in a predetermined pattern and have protruding portions which are distinct from one another and which have been subjected to a liquid repellant surface treatment.

9 Claims, 31 Drawing Sheets

INK JET RECORDING HEAD WITH DISCHARGE OPENING SURFACE TREATMENT

This application is a continuation of application Ser. No. 08/361,453 filed Dec. 21, 1994, which was a continuation of application Ser. No. 07/879,466 filed May 4, 1992, which was a continuation of application Ser. No. 07/758,305 filed Aug. 28, 1991, which was a continuation of application Ser. No. 07/622,140 filed Dec. 4, 1990, which was a continuation of application Ser. No. 07/351,878 filed May 15, 1989, all now abandoned.

BACKGROUND OF THE INVENTION

1. Field of the Invention

This invention relates to an ink jet recording apparatus for use in printers, copying machines, facsimile machines, etc., and more particularly to a method for surface-treating an ink jet recording head provided with at least one discharge opening for discharging a recording liquid, particularly in the neighborhood of the discharge opening.

2. Related Background Art

Among various recording systems so far used, the ink jet recording is known as a non-impact recording system with much less generation of noises during the recording, and is also widely admitted to be a very useful recording system, because high speed recording can be carried out on ordinary plain Rapers as a recording medium without any special fixation treatment. Various modes have been also proposed for the ink jet recording system and many improved ink jet recording systems are commercially available. Still now, efforts have been continuously made for the improvements.

FIGS. 1A, 1B, 1C, 1D and 1E show two modes of an ink jet recording head. FIGS. 1A and 1B show ink jet recording heads, each comprising a nozzle with a single discharge opening using a piezo device as an electromechanical converting means, and FIGS. 1C, 1D and 1E show an example of an ink jet recording head comprising a plurality of discharge openings, where an electro-thermo conversion device is provided in each of liquid paths as a means for generating an energy for use in the liquid discharge.

In FIGS. 1A and 1B, numeral 1 is an ink jet recording head, where a body 3 having a fine hollow liquid path 2 is made of, for example, glass, ceramics or metals, and a discharge opening 5 is provided at the tip end of the body 3 to discharge an ink 4 as a recording liquid from the liquid path 2. Numeral 6 is a piezo device provided around the body 3 as a means for generating an energy for use in the liquid discharge, 7 is a tube of, for example, polyethylene, which is connected to the body 3 to supply the ink 4 to the liquid path 2 in the body 3 from an ink tank (not shown in the drawings). The ink 4 can be discharged from the discharge opening 5 by vibration caused by the piezo device 6 to form at least one droplet.

In FIGS. 1C, 1D and 1E, numeral 10 is a support made of glass or ceramics, 11 is an electro-thermal conversion device provided on the substrate 10 as a means for generating an energy for use in the liquid discharge, 12 is a partition wall portion made of a cured film of a photosensitive resin, in which liquid paths 13 that constitute the partition wall portion 12 and discharge openings 14 at the tip end and a liquid chamber 15 are formed by photolithography. Numeral 16 is a second support made of glass, ceramics or metals, and is laminated upon the partition wall portion 12 made of the cured film of a photosensitive resin, for example, by an adhesive 17. Numeral 18 is a supply hole for supplying an ink 4. The latter ink jet recording head 20 is more distinguished in the provision of discharge openings of smaller size at a higher density than the former ink jet recording head 1.

The ink jet recording method is a method of producing images with a recording liquid utilizing a thermal energy in the formation of droplets of the recording liquid.

In the ink jet recording heads with the foregoing structures or ink jet recording heads provided with an orifice plate having discharge openings (orifices) of a predetermined size at the end of liquid path (not shown in the drawings), physical properties of the surface part in the neighborhood of discharge openings, that is, physical properties of tip end parts 5-1 around the discharge opening 5 in FIGS. 1A and 1B or edge parts of supports 10 and 16 and partition wall portion 12, which constitute the discharge openings 14 in FIGS. 1C to 1E, are very important for stable discharge of the ink from the discharge openings.

As a result of many experiments and investigations, the present inventors have found that, when the ink 4 is discharged from the ink jet recording head, the ink 4 attaches to the parts in the neighborhood of discharge opening, and once an ink pool is formed on these parts, the ink scattering direction will be deviated from the normal direction C predetermined direction, and furthermore, the scattering direction will be disturbed at every ink discharge due to the unstableness of the ink pool and no stable ink discharge can be obtained. In other words, no good recording can be obtained. Furthermore, when an ink film is formed entirely on the parts around the discharge opening, random ink scattering, that is, the so called splash phenomenon, appears and thus no stable recording can be obtained, either, or when the ink pool so develops as to cover the,surface including the discharge opening (discharge opening surface), the ink jet recording head will fail to discharge the liquid droplets.

Particularly in the ink jet recording head shown in FIGS. 1C to 1E, a combination of at least two different materials is often used as members that surround the discharge opening 14. For example, three different materials, e.g. silicon for the first support 10, glass for the second support 16 and the cured film of a photosensitive resin for the partition wall portion 12, are used in the ink jet recording head as shown in FIGS. 1C to 1E. Thus, the surface tension differs from one material to another, and a more wettable material is wetted with the ink at first and an ink pool is readily formed on the more wettable material at first, resulting in unstable discharge by liquid droplets. Furthermore, this phenomenon more frequently occurs when the discharge openings are arranged at a higher density to conduct a finer recording or when the discharge is carried out with a high frequency power to attain a high speed recording. Thus, this is an important problem which must be solved to improve the characteristics of an ink jet recording head.

Many attempts have been so far proposed to solve the problem, for example, by treating the ink discharge surface around the discharge opening so as to repel the ink. However, not only mere surface treatment, but also some special treatment is required for the treatment at the ink discharge surface, because the inner surface in the discharge opening, which requires a higher ink liquid wettability, i.e., a high affinity for the ink, is in contact with the ink discharge surface around the discharge opening, which requires a good ink repellency. Thus, it has been so far utilized to fill a removable filler into the liquid path from the discharge opening side and then treat the outside surface around the discharge opening or spray a surface-treating agent onto the ink discharge surface around the discharge opening by a spraying means, while spouting a gas from the discharge opening.

In an ink jet recording head, wherein the partition wall 12 is as thin as, for example 25 μm, and the wall width between the adjacent discharge openings is as small as, for example, 20 μm, to provide discharge openings at a very high density, an ink droplet 4-1 can be discharged straight without wetting the ink discharge surface 14-1 around the ink discharge opening 14, if the ink discharge opening 14 is in the normal state, as shown in FIG. 2A, where the ink is discharged from the discharge opening 14 by subjecting an electro-thermal conversion device 11 to a heat generation, but when a part of the ink discharge surface 14-1 around the discharge opening is wetted with the ink, the ink droplet is discharged in a deviated direction, as shown in FIG. 2B.

The ink discharge surface 14-1 around the discharge opening is wetted with the ink during the ink discharge not only in this manner, but also by an overflow of the ink in a liquid path 13 from the tip end of the liquid path to the outsides, i.e. the surface including the discharge opening, by mechanical vibrations, etc. caused during the mechanical travelling of the ink jet recording head while printing letters or by returning of the ink jet recording head to the original position from the recording paper surface after the contact therewith. Particularly, these phenomena often occur when the discharge openings are formed on the ink discharge surface 14-1 in the neighborhood of the adjacent discharge openings 14, when the discharge openings 14 are formed on the ink discharge surface 14-1 at a high density, and linking of ink wettings takes place to form chains of ink wettings across the adjacent discharge openings and the influence becomes more and more pronounced. As a result, deformation of printed letters or disturbance of printed images takes place to give a considerably adverse effect upon the quality of printed letters or images.

Conventional ink jet recording heads with mirror-finished ink discharge surfaces 14-1 have been studied and it has been found that the mirror-finished ink discharge surfaces are readily wettable with an ink for the foregoing reasons, and thus ink jet recording heads with the mirror-finished ink discharge surfaces further coated with an ink-repellent agent have further been studied. However, it has been found that the foregoing prior art still has the following inherent technical problems with respect to the durability of ink repellency.

That is, conventional ink jet recording heads have been mounted on an ink jet recording apparatus as shown in FIG. 3 to investigate the state in the neighborhood of discharge openings in the ink jet recording heads and the quality of printed images, and have found the following problems:

(1) As one of functions of an ink jet recording apparatus, a mechanism of wiping the ink discharge surface, which has been surface-treated to give an ink repellency, with a rubber blade to prevent the discharge openings from clogging due to the attachment of paper dusts, etc. from recording papers at the initial position of a recording head, etc. Thus, the surface-treating agent layer, that is, the coating layer of a surface-treating agent, is highly liable to peel off when wiped with the rubber blade.

(2) The surface-treating agent layer on the mirror-finished ink discharge surface has a poor durability and often peels off from the boundary surfaces between different materials that constitute the ink discharge surface, when used as a printer for a long time, and the ink repellency is gradually decreased and the quality of printed letters or images is also deteriorated thereby.

SUMMARY OF THE INVENTION

An object of the present invention is to provide an ink jet recording head capable of stably dischanging an ink in the predetermined direction and satisfactorily applicable is high speed, fine recording while solving the foregoing technical problems.

Another object of the present invention is to provide a method for surface-treating an ink jet recording head with a high productivity, thereby providing the aforementioned ink jet recording head, or a method for producing such an ink jet recording head.

Another object of the present invention is to provide an ink jet recording head capable of stably discharging an ink in the predetermined direction and satisfactorily applicable to high speed, fine recording by an ink repellent surface treatment with a high durability.

A further object of the present invention is to provide a method for surface-treating an ink jet recording head to give a good ink repellency with a high durability, thereby providing the aforementioned ink jet recording head, or a method for producing. such an ink jet recording head.

Still a further object of the present invention is to provide a method for surface-treating an ink jet recording head for recording based on discharge of an ink from a discharge opening communicating with a liquid path, which comprises forming fine irregularity on a surface including the discharge opening and subjecting the fine irregularity-formed surface including the discharge opening to an ink liquid repellent surface treatment.

Another object of the present invention is to provide a method for surface-treating an ink jet recording head for recording based on discharge of an ink liquid from a discharge opening communicating with a liquid path to which the ink is supplied, which comprises impregnating a support comprising a porous material with a surface-treating agent and contacting the surface of the support with a surface including the discharge opening of the recording head, thereby subjecting the surface to an ink liquid repellent surface treatment.

Still another object of the present invention is to provide a method for surface-treating an ink jet recording head for recording-based on discharge of an ink from a discharge opening communicating with a liquid path, which comprises transferring a surface-treating agent to a surface including the discharge opening by use of a support comprising a material capable of swelling with a liquid containing the surface-treating agent.

Still another object of the present invention is to provide a method for surface-treating an ink jet recording head for recording based on discharge of an ink from a discharge opening communicating with a liquid path, which comprises transferring a surface-treating agent to a surface including the discharge opening by use of a support having an irregularity on the surface thereof, thereby subjecting the surface including the discharge opening to an ink liquid repellent surface treatment.

Still another object of the present invention is to provide a method for surface-treating an ink jet recording head for recording based on discharge of an ink from a discharge opening communicating with a liquid path, which comprises transferring a surface-treating agent to a surface including the discharge opening by use of a support having a surface of irregularity at a pitch not more than one-half of the opening size of the discharge opening, thereby subjecting the surface to an ink liquid repellent surface treatment.

Still another object of the present invention is to provide a method for surface-treating an ink jet recording head for recording based on discharge of an ink from a discharge opening communicating with a liquid path, which comprises forming a surface-treating layer in an area of 60% to 90% on the basis of the specific area on a surface including the discharge opening, thereby subjecting the surface to an ink liquid repellent surface treatment.

Still another object of the present invention is to provide an ink jet recording head, which comprises a discharge opening for discharging an ink, a liquid path communicating with the discharge opening and means for generating a discharge energy provided in the liquid path, an area in which an ink liquid repellent surface-treating layer is provided being 60% to 90% on the basis of the specific area on a surface including the discharge opening.

Still another object of the present invention is to provide an ink jet recording head, which comprises a discharge opening for discharging an ink, a discharge energy generator provided in a liquid path communicating with the discharge opening, and an ink liquid repellent surface-treating layer being distributed in an insular pattern on a surface including the discharge opening.

DESCRIPTION OF THE PREFERRED EMBODIMENTS

The following description of the preferred embodiments of this invention relates generally to the invention as claimed. Particular support for that invention can be found in the description of Examples 26 through 31, and the Figures corresponding thereto.

In the present invention, a surface-treating agent can be selected appropriately as desired, so long as a surface-treating layer to be ultimately formed on the discharge opening surface can have an ink liquid repellency (for example, oil-repellent in case that the ink is oil-based, or water-repellent in case that the ink is water-based) and also can satisfy the conditions for attaining the objects of the present invention at the same time. That is, the surface-treating agent may be a material having an ink liquid repellency from the beginning or a material capable of producing an ink liquid repellency by some treatment. Anyway, any surface-treating agent can be used so long as the surface of the ultimately formed surface-treating layer can have an ink repellency.

The surface-treating agent for use in the present invention includes liquid or solid surface-treating materials capable of directly contributing to the ink liquid repellency of the surface-treating layer, solutions of the liquid or solid surface-treating materials in a solvent, dispersions of the liquid or solid surface-treating materials in a dispersing medium, etc.

According to a first preferable embodiment of the present invention, a fine irregularity portion is formed on the ink discharge surface of an ink jet recording head, and a surface-treating agent is transferred by use of a support onto the irregularity-formed, ink discharge surface to form an ink liquid-repellent, surface-treating layer on the ink discharge surface. In the first embodiment, a solid or liquid surface-treating agent or, if necessary, so treated as to ultimately form a solid surface-treating layer on the ink discharge surface of an ink jet recording head, can be used. Specifically, the surface-treating agent includes solid or liquid photosensitive resins, solutions of photosensitive resins in a solvent, dispersions of photosensitive resins in a dispersing medium, liquid thermo-setting resins, solutions of thermo-setting resins in a solvent, dispersions of the thermosetting resins in a dispersing medium, liquid coupling agents of silane system, titanate system, chromium system, aluminum system, fluorine system, fluorosilicone system, etc., and solutions of coupling agents in a solvent.

The foregoing method and materials are appropriately select in embodiments which follow.

Solidification can be carried out by drying such as natural drying or forced drying, for example, heating, if the surface-treating agent is in a liquid state, or by irradiation of chemically actinic rays if the surface-treating agent is a photosensitive resin of a solution thereof or by heating if the surface-treating agent is a thermosetting resin or a solution thereof.

EXAMPLE 1

Figure 1A:
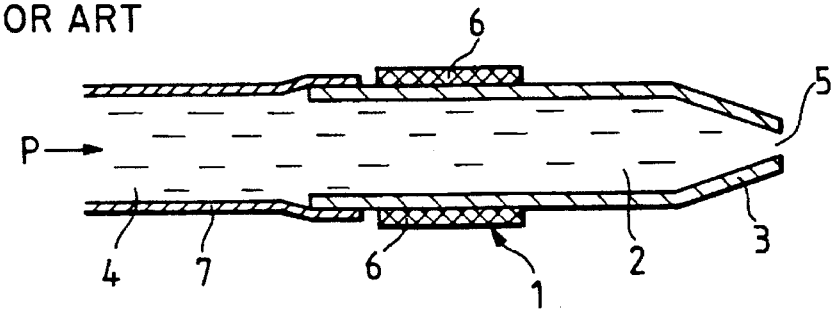
FIG. 1A PRIOR ART
FIGS. 1A, 1B, 1C, 1D and 1E are schematic views of an ink jet recording head to which the present invention is applicable.
Figure 1B:
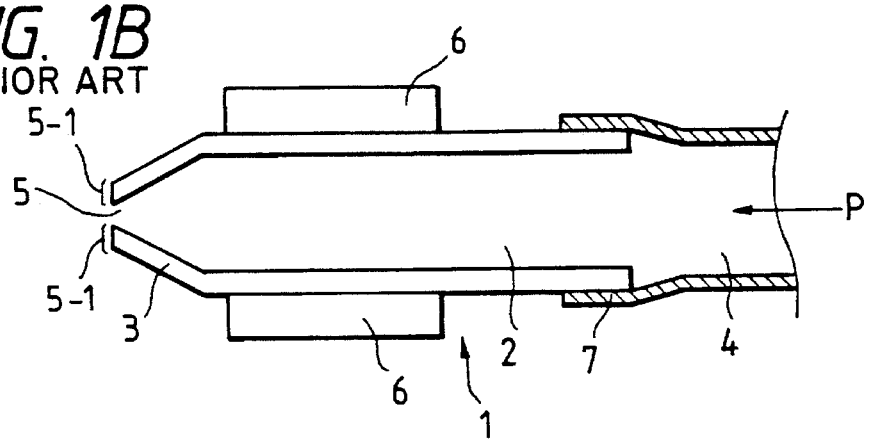
FIG. 1B PRIOR ART
Figure 1C:
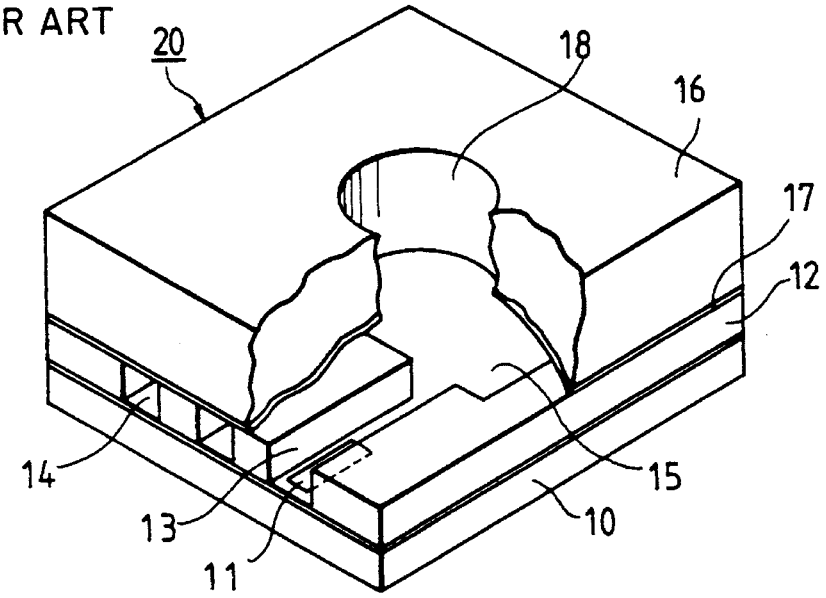
FIG. 1C PRIOR ART
Figure 4:
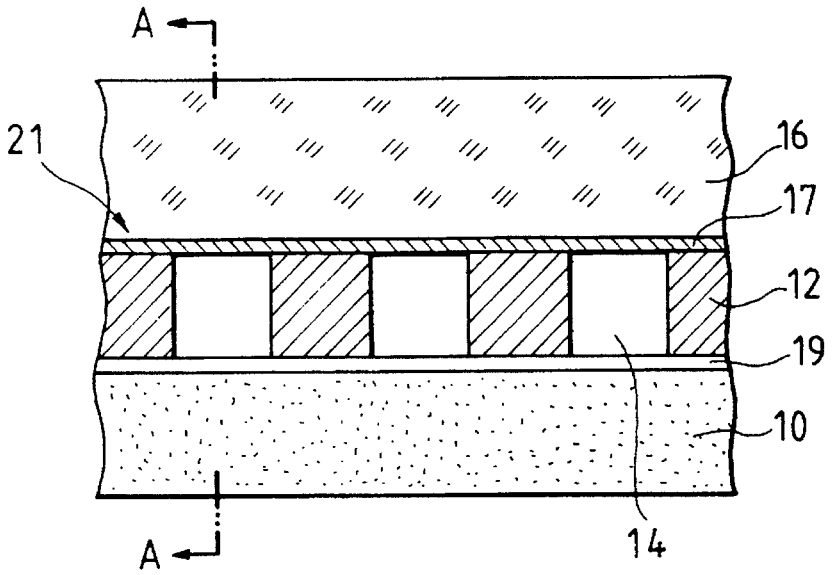
FIG. 4 is a schematic front view showing the ink discharge surface of an ink jet recording head to which the present invention is applicable.

In this example an ink jet recording head as shown in FIG. 1C was prepared in the following manner, where the ink surface including discharge openings as shown in FIG. 4 were formed.

Figure 3:
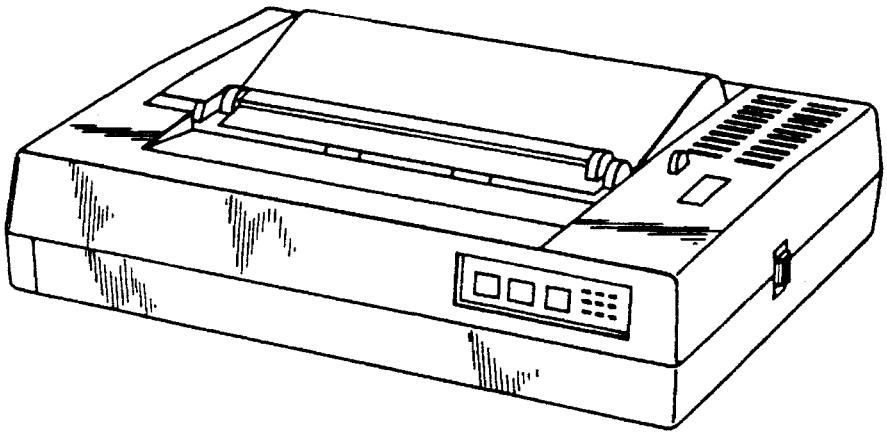
FIG. 3 PRIOR ART
FIG. 3 is a schematic view of an ink jet recording apparatus to which the present invention is applicable.

At first, electro-thermal conversion devices 11 of, for example, Ta—Al alloy were provided as means for generating a discharge energy on a first substrate 10 of silicon, and conductor wirings of, for example, Al were connected to both ends of each of the electro-thermal conversion devices 11 to transmit an ink discharge signal thereto. A film of a photosensitive resin was laminated upon the first substrate 10, and then discharge openings 14, liquid paths 13 and a liquid chamber 15 were formed thereon by photolithography. Furthermore, a second substrate 16 of glass provided with an ink supply hole 18 was laminated upon and fixed to the nozzle wall 12 of a cured film of a photosensitive resin through an adhesive layer 17 by adhesion, and an ink discharge surface 14-1 as shown in FIG. 3 was formed by grinding along the line B—B by a slicing machine 26 using a diamond cutting grinding stone 25, whereby a recording head in the form as shown in FIG. 1C was obtained.

In order to obtain the surface roughness of discharge opening peripheral parts, that is, the ink discharge surface according to the present invention, a diamond cutting grinding stone having a diamond grain size of 10 μm to 30 μm was used in the grinding of the ink discharge surface 14-1, whereby pear-like surfaces of uniform irregularity, that is, average R of surface roughnesses R (difference in height between the bottom of concave part and the top of convex part) ranging 0.5 μm to 3 μm were readily prepared. In this manner, sample 1 having a surface roughness R of 3 μm and sample 2 having R of 0.5 μm were prepared.

Figure 6:
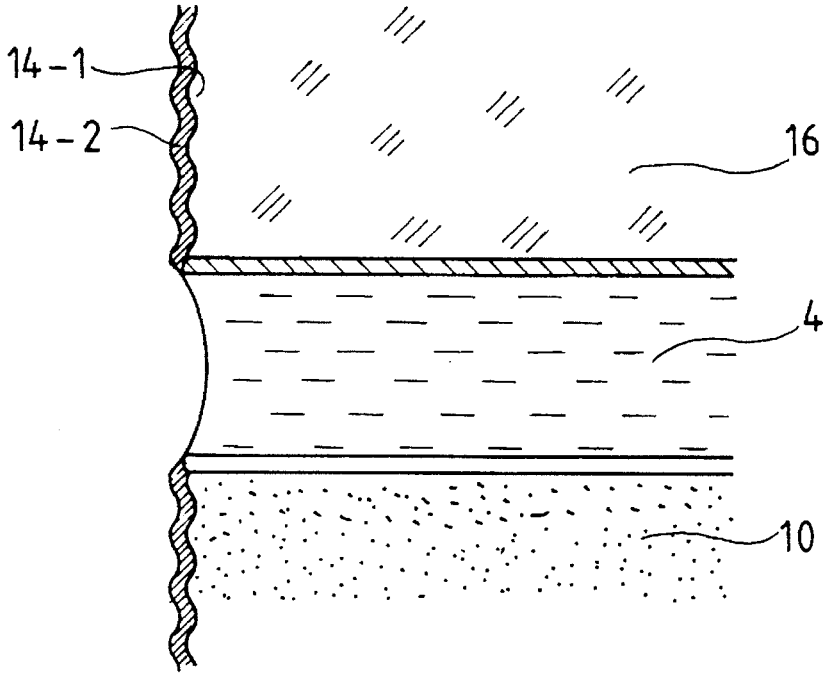
FIGS. 6 and 7 are schematic cross-sectional views explaining the surface treatment according to the present invention.
Figure 7:
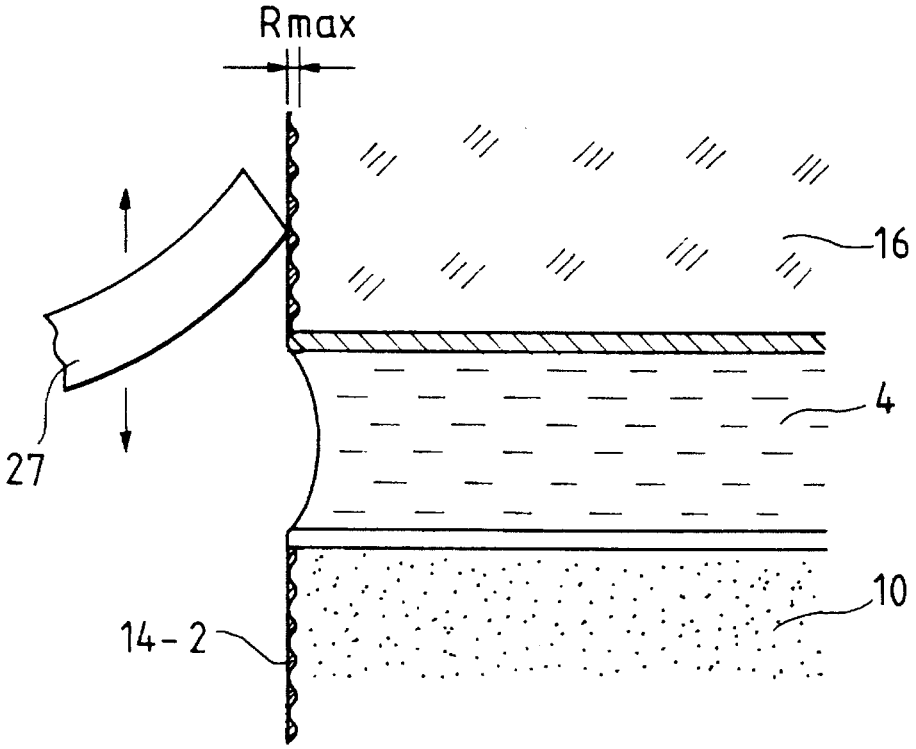

In order to form a surface-treating layer on the thus obtained ink discharge surface 14-1 of pear-like surface irregularity, a surface-treating agent was uniformly sprayed, for example, on an elastomer resin as a support, while the excess surface-treating agent was removed from the support by a sgueezee, etc. and subject to a transfer treatment. In this manner, a surface-treating agent layer 14-2 was formed on the ink discharge surface, as shown in FIG. 6. Then, the ink jet recording head was mounted on an ink jet recording apparatus and the surface-treating agent layer was wiped with a rubber blade 27 as a wiping means, shown in FIG. 7, whereby the surface-treating layer was made thin at the tops of convex parts, whereas the surface-treating layer 14-2 was retained deep in the concave parts to ensure tight fixation of the surface-treating layer 14-2 to the ink discharge surface 14-1. That is, the ink liquid repellency could be maintained for a long time.

EXAMPLE 2

In this example, the ink discharge surfaces ground by the slicing machine 26 were further subjected to a lapping treatment with abrasives of several Grain sizes, GC (trademark of products made by Fujimi Kenmazai K.K.,Japan) to make the ink discharge surfaces 14-1 have average surface roughnesses R ranging from 5 μm to 20 μm, and ink jet recording heads with the thus lapped ink discharge surfaces were mounted on ink jet recording apparatuses and tested, as will be described later. Samples having average surface roughness R of 20 μm (sample 3), 10 μm (sample 4) and 5 μm (sample 5) were selected for the tests. More rough surfaces could be obtained than those obtained by Grinding only with the cutting Grinding stone.

In this example, the lapping was carried out while pumping water from the supply hole 18 to the discharge openings 14 in order to prevent the discharge openings 14 from clogging with the abrasive powder. Formation of the surface treating layer 14-2 in the lapped ink discharge surface 14-1 was carried out in the same manner as in Example 1.

Comparative Example

In order to compare the surface roughness of the ink discharge surfaces of Examples 1 and 2 with that of a conventional one, the ink discharge surface was mirror-finished by regrinding the ink discharge surface, which was once ground by the slicing machine 21, by another diamond cutting grinding stone having a finer diamond grain size (grain size: 3 μm) and a 20% larger grinding stone thickness along the same tracks as before to prepare the ink discharge surface of an ink jet recording head (sample 6).

The surface-treating agent used for the surface-treatment of the ink discharge surfaces of all the ink jet heads prepared according to the foregoing Examples 1 and 2 and Comparative Example were KP-801 (trademark of a product made by Shinetsu Kagaku Kogyo K.K., Japan) and FS-116 (trademark of a product made by Daikin Kogyo K.K., Japan)

and these were subjected to the surface treatment in the same manner as in Example 1, followed by drying at 150° C. for 2 hours.

Then, the ink jet recording heads with the ink discharge surfaces having the surface-treating layer thus obtained in Examples 1 and 2 and Comparative Example were tested in the ink jet recording apparatus. Test results of the printed letters are shown in Table 1.

TABLE 1

| | Test results of printed letters | | | | | |
|---|---|---|---|---|---|---|
| Method | Example 1 | | | Example 2 | | Comparative Example |
| surface finishing | 1 Cutting grinding stone #600 grain size: 30 μm | 2 Cutting grinding stone #1,500 grain size: 10 μm | 3 Abrasive #600 grain size: 30 μm | 4 Abrasive #1,500 grain size: 15 μm | 5 Abrasive #2,500 grain size: 8 μm | 6 Cutting grinding stone #4,000 grain size: 3 μm |
| average surface roughness R | 3 μm | 0.5 μm | 20 μm | 10 μm | 5 μm | Mirror surface |
| Evaluation of printed letters affer rubber blade wiping | | | | | | |
| Initial | ⊙ | ⊙ | X | ○ | ⊙ | ⊙ |
| 100 wipings | ⊙ | ⊙ | X | ○ | ⊙ | ○ |
| 1,000 wipings | ⊙ | ⊙ | X | ○ | ⊙ | Δ |
| 10,000 wipings | ⊙ | ⊙ | X | ○ | ⊙ | X |

Remarks: ⊙: Best; ○: Good; Δ: Somewhat poor; X: Poor

That is, sample 3 had too rough a surface and defects appeared around the discharge openings. Thus, the state of printed letters was poor even at the initial stage. On the other hand, samples 1, 2 and 5 of Examples 1 and 2 and sample 6 of Comparative Example had a very good state of printed letters at the initial stage, but it was found that the quality of printed letters of sample 6 was continuously lowered with repeated wipings with a rubber blade, as compared with samples 1, 2, 4 and 5. The ink jet recording head with surface-treated ink discharge surfaces of fine irregularity had a tight adhesion between the ink discharge surface and the surface-treating layer and could maintain a stable ink discharge for a long time. It was found that the surface roughness R on such a level as not to lower the quality of printed letters due to the defects appearing around the discharge openings, as a degree of fine surface irregularity, was preferably 0.5 μm to 10 μm, more preferably up to 5 μm.

Figure 8:
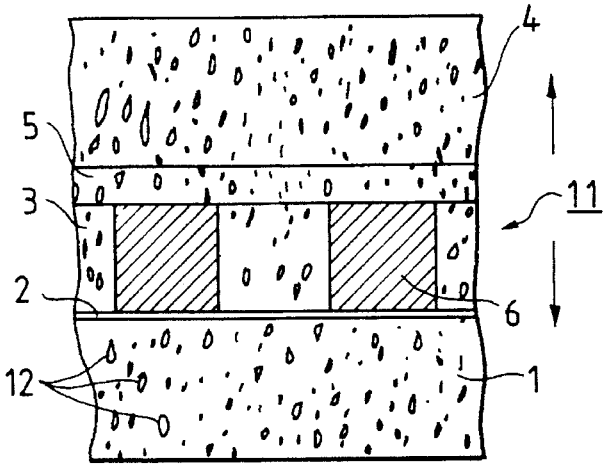
FIGS. 8 and 9 are schematic front views explaining the surface treatment according to the present invention.
Figure 9:
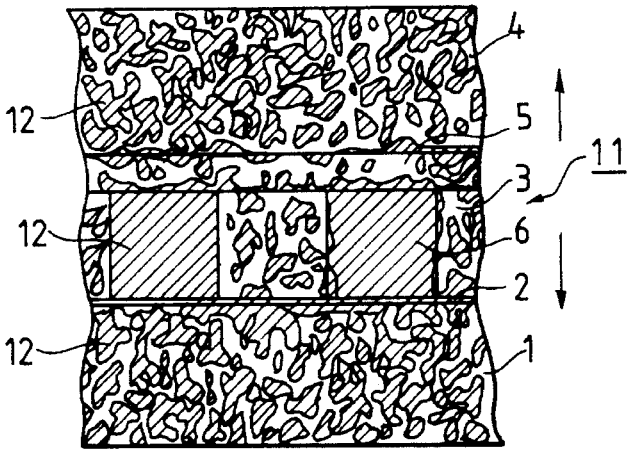
Figure 10:
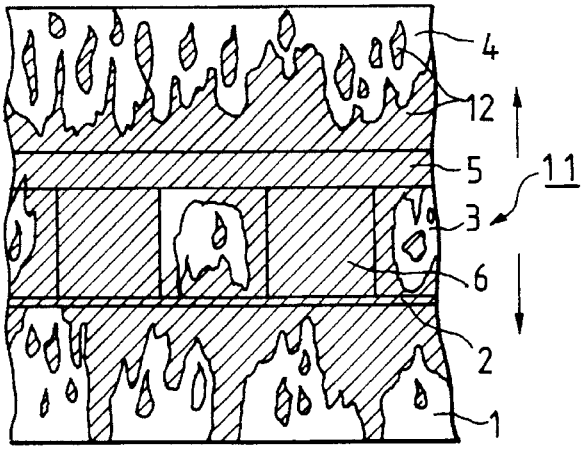
FIG. 10 is a schematic front view explaining the surface treatment according to the prior art.

FIGS. 8 to 10 show states of ink deposition on the ink discharge surface after 10,000 wipings with a rubber blade in the arrow direction. That is, FIG. 8 shows the state of ink deposition when the ink discharge surfaces having a fine irregularity of samples according to Example 1 were surface treated, where the ink took a small droplet state and a very high ink repellent effect was maintained on the ink discharge surface 14-1. FIG. 9 shows the state of deposition of ink 12 on the ink discharge surface having a surface roughness R of 20 μm around the discharge openings 6 in case of sample 3, where the ink remained in the concave parts of the irregular ink discharge surface or around the defects at the peripheral parts of discharge openings 6. FIG. 10 shows coating of the mirror-finished surface with a surface-treating layer in case of sample 6. Where most of the surface-treating layer was peeled off from the boundaries between the different materials, that is, between the glass or silicon as inorganic materials and the cured film of a photosensitive resin as an organic material, and the ink deposition was remarkable, particularly, on the cured film of a photosensitive resin.

In the method for surface-treating an ink jet recording head for discharging an ink from a discharge opening formed at the tip end of a liquid path to scatter the ink as liquid droplets for recording, at least the peripheral parts of discharge opening on the ink discharge surface including the discharge opening is made a pear-like surface having a fine irregularity and the pear-like parts on the ink discharge surface is surface-treated with a surface treating agent in Examples 1 and 2, as explained above, whereby the resulting surface-treating layer can be prevented from peeling even when wiped with a rubber blade and a stable ink discharge can be maintained for a long time. Thus, an ink jet recording head capable of printing letters or images with a high quality can be obtained in the present invention.

According to a second embodiment of the present invention, a porous material is used as a support. As the porous material, porous materials of mutually communicating pores made of ceramics, sponge, resin, etc. are preferable. Porous elastomer materials are more preferable. Specifically, the porous materials include ceramic filter, sponge, mesh filter, urethane rubber, etc. Among the porous materials, those having a smaller pore size than the opening size of the discharge opening of an ink jet recording head, whose ink discharge surface is to be surface-treated, are preferable. Those having a pore size not more than one-half of the opening size of the discharge opening are more preferable. Those having a pore size not more than ¼ of the opening size of the discharge opening are most preferable.

EXAMPLE 3

In this example, an ink jet recording head with the structure shown in FIGS. 1A and 1B was prepared and was ultrasonically washed in methylethylketone (MEK) and then in Daiflon S3 (trademark of a product made by Daikin Kogyo K.K., Japan) each for 5 minutes to clean the peripheral parts of the Discharge opening, and further washed by an HV ozone washer for 3 minutes.

Figure 11A:
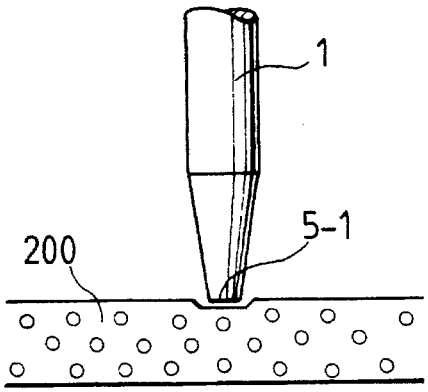
FIGS. 11A and 11B are schematic views explaining the surface treatment according to the present invention.
Figure 11B:
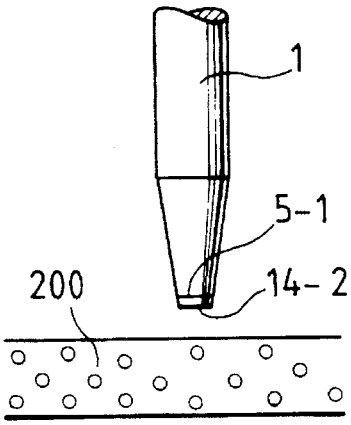

On the other hand, a porous elastomer, Belleater (trademark of a product: made by Kanebo K.K., Japan) as a transfer support was thoroughly dipped in a Daiflon S3 solution containing 1% by weight of a fluorosilicone-based, surface treating agent, KP 801 (trademark of a product made by Shinetsu Kagaku Kogyo K.K., Japan) and pulled up, whereby the Belleater support was uniformly impregnated with the surface treating agent. The support had an average pore size of not more than one half of the opening size of orifice 5. Urethane sponge, etc. can be used as the support. In FIGS. 11A and 11B, numeral 200 is a porous elastomer as the support. Thus, when the tip end of an ink jet recording head 1 was brought into contact with the support so as to press the support lightly from the overhead, as shown in FIG. 11A, the film 14-2 of the surface-treating agent could be deposited onto the tip end 5-1 of the ink jet recording head, as shown in FIG. 11B.

Since the support 200 is an elastomer in the foregoing transfer method, the ink jet recording head 1 will not be damaged even if the discharge opening 5-1 of the ink jet recording head 1 is pressed on the support 200, and also permeation of the surface-treating agent, that is, the solution of the surface-treating agent, into the liquid path 2 from the discharge opening 5 can be prevented. That is, the surface-treating agent is kept to remain in the mutually communicating pores in the support 200 in this example, and the solution of the surface treating agent is transferred only onto the ink discharge surface 5-1 through the mutually communicating pores. Furthermore, the surface of the support 200 is immediately compensated with the surface-treating agent through the mutually communicating pores as soon as the transfer is completed, and thus the same transfer operation as above can be successively and continuously applied to the ink discharge surfaces of other ink jet recording heads.

In this example, the ink jet recording head 1 was heated at 150° C. for 30 minutes after the transfer operation, thereby curing the surface treating agent through reaction. Thus, a surface-treating layer of almost uniform thickness could be strongly bonded to the ink discharge surface 5-1 of the ink jet recording head. As a result, the surface-treating layer was formed only on the ink discharge surface of the ink jet recording head 1 and the state of meniscus formed at the discharge opening 5, as will be described later, could be maintained normally.

When pure water was filled in the nozzle and the ink discharge surface of the ink jet recording head was dipped in the surface-treating agent according to a conventional method on the other hand to form a surface treating agent layer on the ink discharge surface 5-1 of the ink jet recording head, a portion of the surface-treating agent entered into the discharge opening 5 and was fixed to the inside of the discharge opening 5 and thus no normal meniscus was maintained at the discharge opening 5.

EXAMPLE 4

Figure 12A:
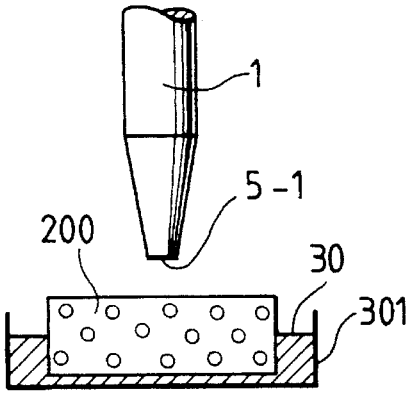
FIGS. 12A and 12B are schematic views explaining the surface treatment according to the present invention.

In this example, an ink jet recording head 1 as cleaned in the same manner as in Example 3 was used on one hand. On the other hand, the same support 200 as used in Example 3 was dipped in a vessel 301 filled with a surface-treating agent 30, as shown in FIG. 12A, while keeping the upper side of the support 200 as exposed from the liquid level of the surface-treating agent 30. In this example, the same surface-treating agent as in Example 3 was used.

Figure 12B:
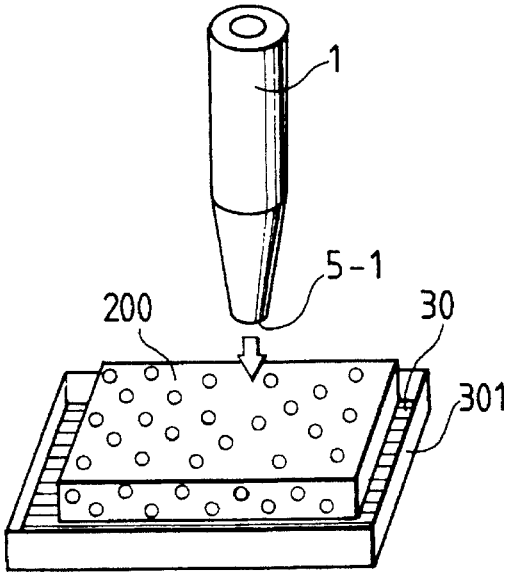

When, the ink discharge surface 5-1 of the ink jet recording head 1 was brought into contact with the support 200 as dipped in the surface-treating agent 30 in the vessel 301, as shown in FIG. 12B, whereby the surface-treating agent could be transferred onto the ink discharge surface 5-1 in the same manner as in Example 3. In this example, the support can be very readily compensated with the surface-treating agent and the surface-treating agent can be continuously transferred onto a large number of ink jet recording heads. The thus transferred surface-treating agent was cured through reaction in the same manner as in Example 3.

In this example, the surface treating agent layer 14-2 could be normally transferred only onto the ink discharge surface 5-1 without entering of the surface-treating agent into the discharge opening 5 and without fixing of the surface treating agent to the inside of the discharge opening. Good, high speed recording could be carried out because the meniscus at the discharge opening 5 was not in an abnormal state as encountered so far.

EXAMPLE 5

Figure 1D:
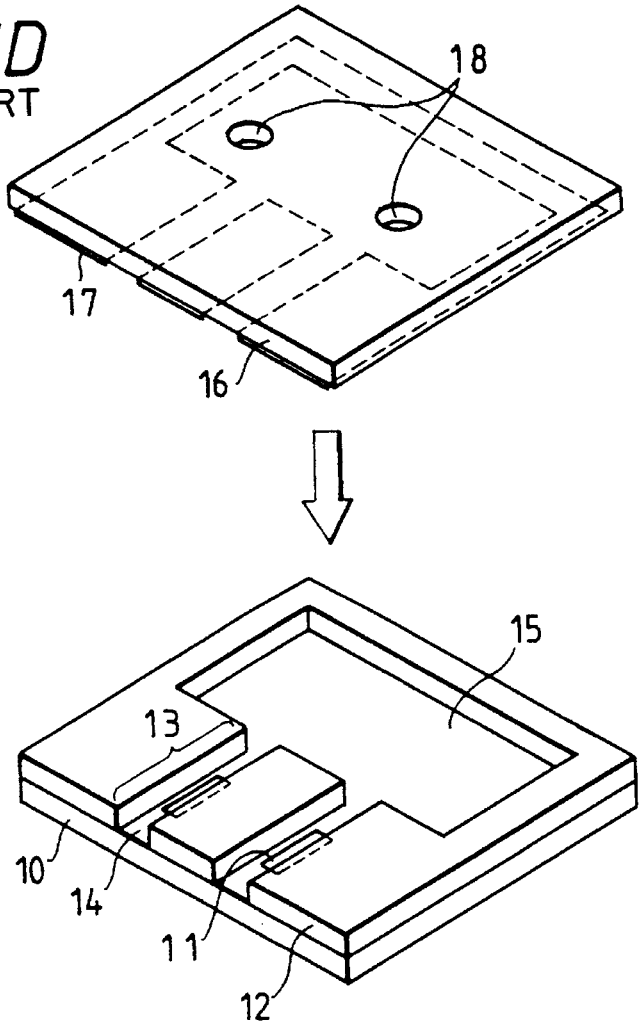
FIG. 1D PRIOR ART
Figure 1E:
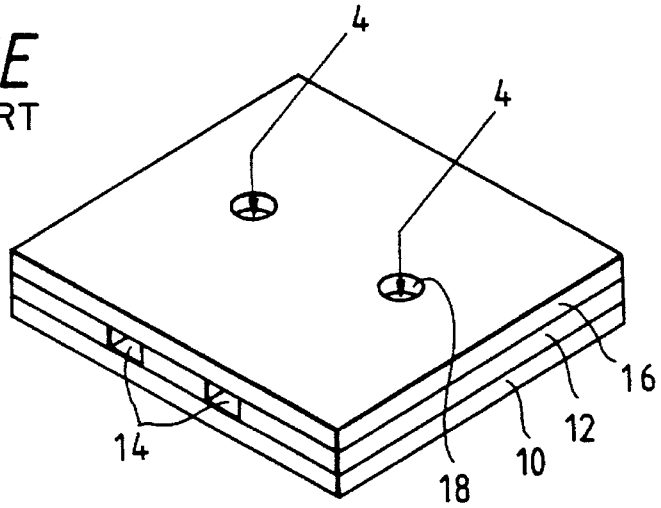
FIG. 1E PRIOR ART
Figure 13A:
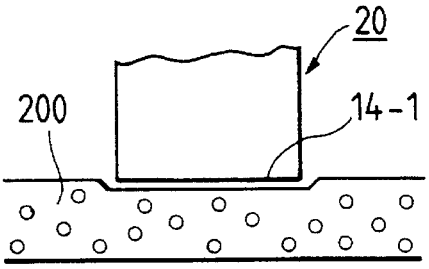
FIGS. 13A and 13B are schematic views explaining the surface treatment according to the present invention.
Figure 13B:
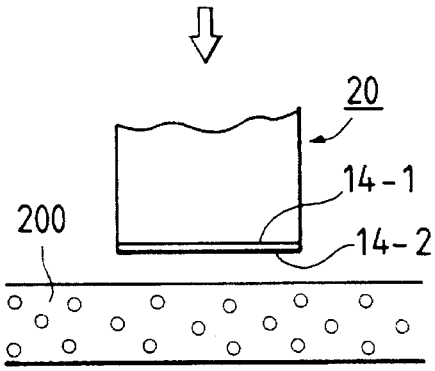

FIGS. 13A and 13B show an example of transferring a surface-treating agent 30 onto the ink discharge surface 14-1 of an ink jet recording head 20 in the form as shown in FIGS. 1C to 1E. That is, in an ink jet recording head 20 as shown in this example, the peripheral parts for forming discharge openings 14 are often composed of a combination of different materials and thus the surface treatment of the ink discharge surface 14-1 must be particularly carefully carried out. Also in this example, cleaning of the ink discharge surfaces 14-1 and impregnation of porous elastomer support 200 with a surface treating agent 30 were carried out in the same manner as in Examples 3 and 4 and the surface-treating agent 30 was transferred onto the discharge surface 14-1, as shown in FIGS. 13A and 13B. Then, the transferred surface-treating agent was cured through reaction in the same manner as in Examples 3 and 4.

EXAMPLE 6

Figure 14A:
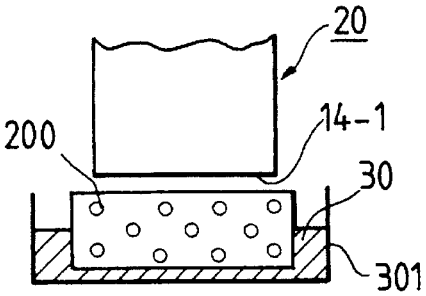
FIGS. 14A and 14B are schematic views explaining the surface treatment according to the present invention.
Figure 14B:
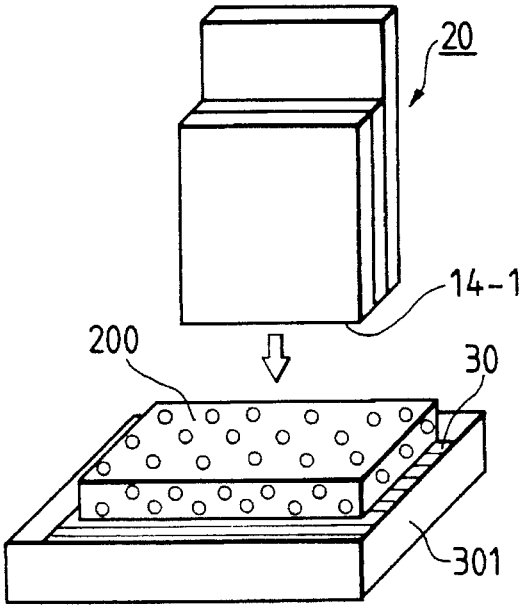

FIGS. 14A and 14B show an example of transferring a surface-treating agent to the ink discharge surface of an ink jet recording head 20 in the form as shown in FIGS. 1-C to 1-E in the same manner as in Example 4, where a support 200 is dipped into a vessel filled with the surface-treating agent 30 and the surface-treating agent is transferred onto the ink discharge surface 14-1 of the ink jet recording head 20 by contacting the ink discharge surface 14-1 with the upper side of the support 200. Detailed explanation of the mechanism will be omitted; because the mechanism is the same as explained in Example 4.

Figure 15A:
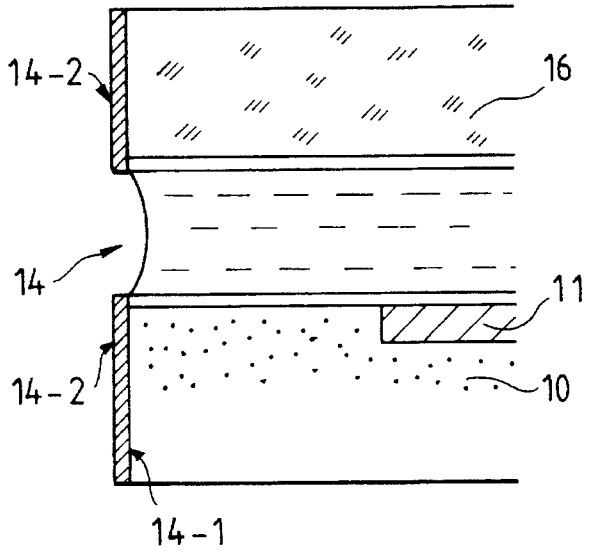
FIG. 15A is a schematic cross-sectional view explaining the state of a meniscus formed by an ink jet recording head according to the present invention.
Figure 15B:
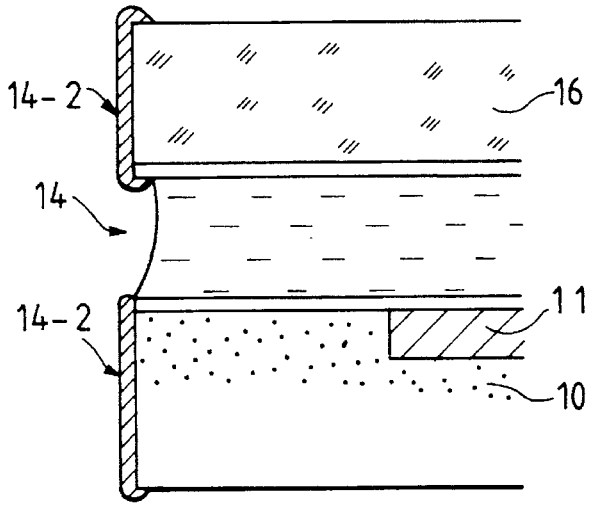
FIG. 15B is a schematic cross-sectional view explaining the state of a meniscus formed by an ink jet recording head according to the prior art.

When an ink jet recording head 20 as shown in FIGS. 1C to 1E was used, as explained in the foregoing Examples 3 to 6, a uniform surface-treating layer could be formed at the parts around the discharge opening, as shown in FIG. 15A. In this case the surface-treating layer 14-2 was not formed on the inside of the discharge opening 14. When a surface-treating agent layer 14-2 of an ink jet recording head 20 in a conventional manner, for example, by coating, etc. on the other hand, the surface-treating agent was deposited on the inside of the discharge opening 14 to form an abnormal meniscus, as shown in FIG. 15B, and the discharge direction of ink and or the scattering direction of ink droplets was disturbed with an ink jet recording head with the abnormal meniscus at the discharge openings.

EXAMPLE 7

Further embodiment of the present invention will be described in detail below, referring to FIG. 16.

At first, an ink jet recording head in the form as shown in FIGS. 1-A and 1-B was prepared and ultrasonically washed in methylethylketone (MEK) and then Daiflon S3 (trademark of a product made by Daikin Kogyo K.K., Japan), each for 5 minutes and further washed in an UV ozone washer for 3 minutes to clean the peripheral parts of the discharge opening.

On the other hand, Daiflon S2 (trademark of a product made by Daikin Kogyo K.K., Japan; solidification point 26° C.) was heated to 40° C. to bring it into a liquid state, and then a fluorosilicon-based, surface-treating agent KP 801 (trademark of a product made by Shinetsu Kagaku Kogyo K.K., Japan) was odded thereto to make a 2 wt. % solution of the surface-treating agent. Then, a porous material Belleater(trademarks of a product made by Kanebo K.K., Japan) was dipped in the solution of surface-treating agent while keeping the solution at 40° C. to impregnate the porous material with the surface-treating agent, and then the porous material was pulled up from the solution and left standing at room temperature (about 20° C.). Daiflon S2 as the solvent was in a solid state in the porous material at room temperature (about 20° C.), because its solidification point was 26° C., and the surface-treating agent was uniformly distributed therein.

Figure 16:
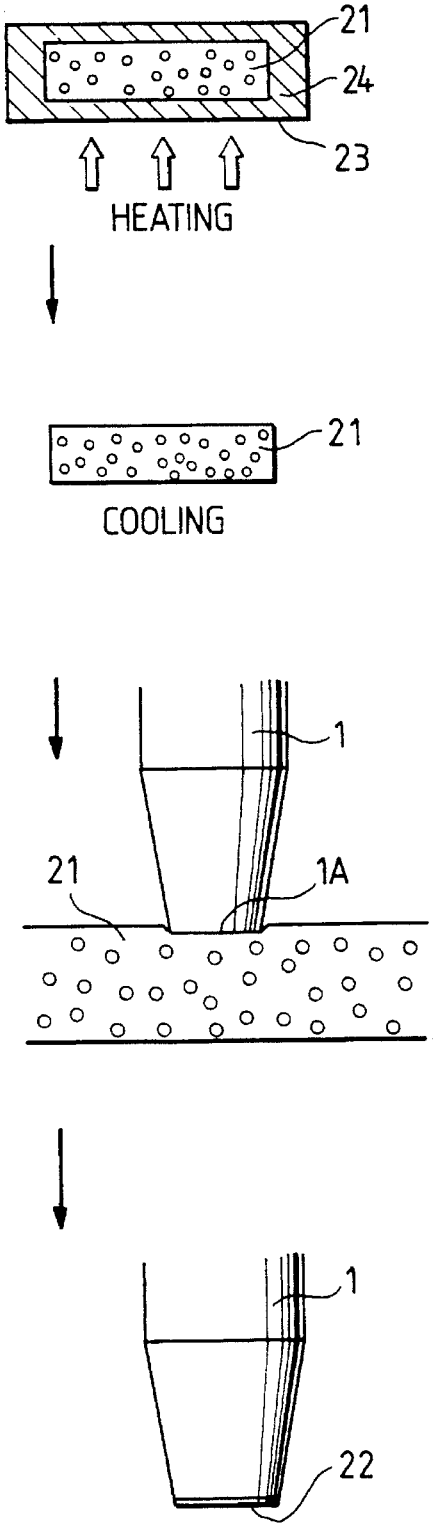
FIG. 16 is a schematic view explaining the surface treatment according to the present invention.

Then, the ink jet recording head was heated to 80° C. in an oven and then withdrawn and immediately the ink discharge surface 5-1 of the ink jet recording head was lightly pressed on the porous material from the overhead, as shown in FIG. 16. In this case, the time from the withdrawal from the oven till the pushing onto the porous support 200 was limited to not more than 10 seconds so that the temperature of the ink jet recording head may not be lower than 40° C. When the ink discharge surface of the heated ink jet recording head 1 was pressed on the porous material and brought into contact therewith, the surface-treating agent retained in a solid state in the porous material was melted at the surface part in contact with the ink jet recording head and thus Daiflon S2 containing the water-repelling agent was transferred onto the ink discharge surface of the ink jet recording head. Then, the ink jet recording head was heated again in an oven at 150° C. for 2 hours, Daiflon S2 was evaporated off and the remaining surface-treating agent was cured through reaction.

In the foregoing Examples 3 to 7, a porous material is impregnated with a surface-treating agent and the ink discharge surface of an ink jet recording head is brought into contact with the porous material. Thus, the surface-treating agent can be uniformly deposited only onto the peripheral parts around the discharge opening and the entering of the surface-treating agent into the orifice can be prevented to a maximum.

EXAMPLE 8

In order to make the present invention more effective, the surface of an ink jet recording head may be processed in the following manner.

Figure 5:
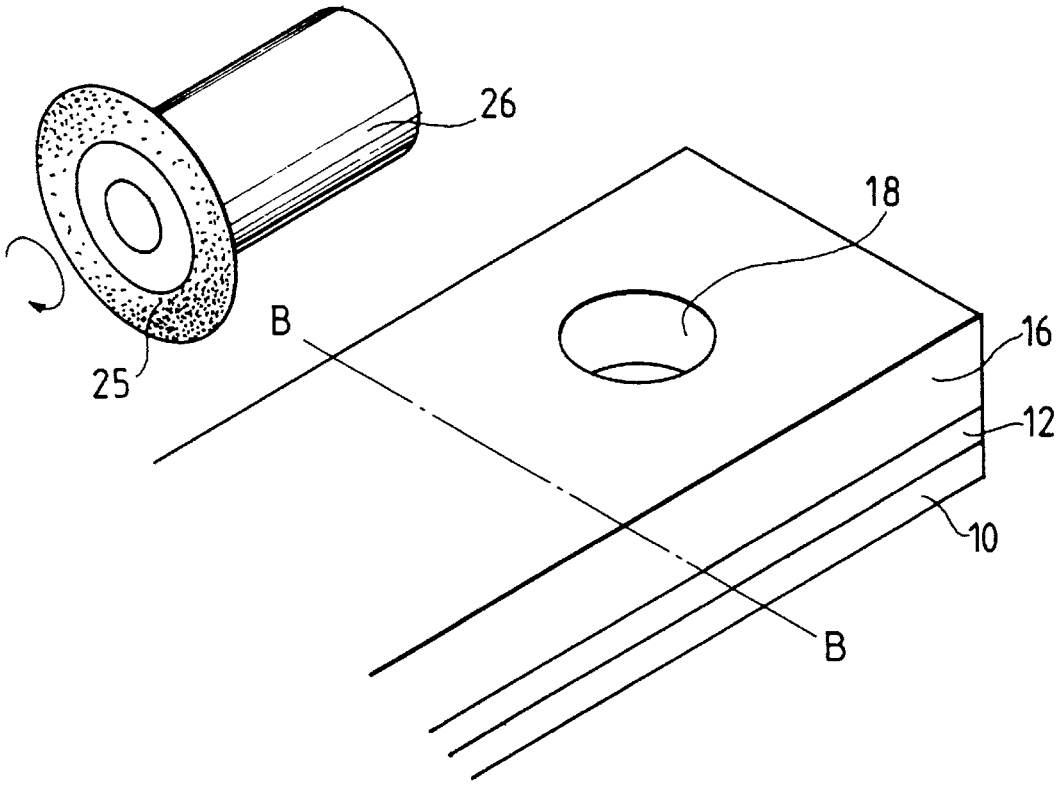
FIG. 5 is a schematic view explaining the process steps of preparing an ink jet recording head according to the present invention.
Figure 17:
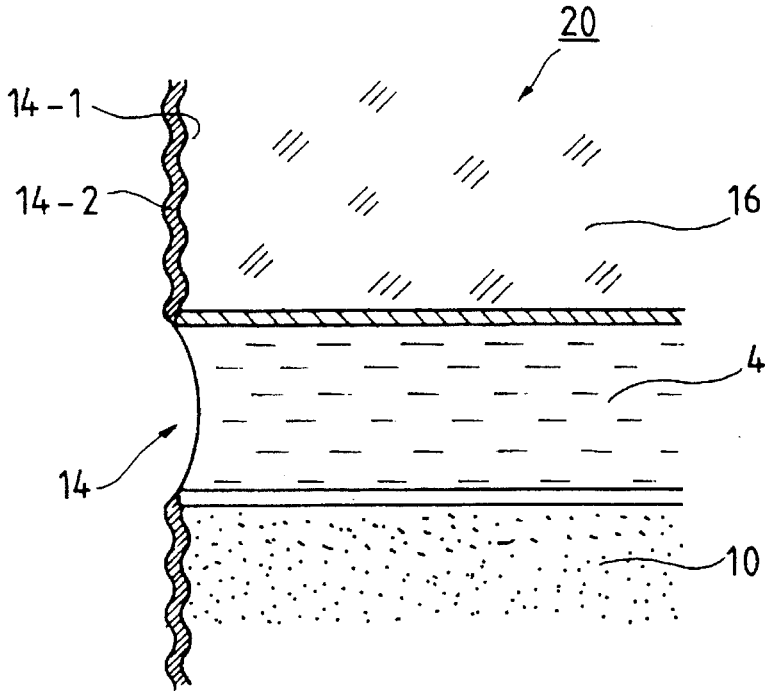
FIG. 17 is a schematic cross-sectional view of an ink jet recording head, which explains the surface treatment according to the present invention.

An ink jet recording head 20 is processed by grinding with a slicing machine 26 using a diamond cutting grinding stone 25 along the line B—B as shown in FIG. 5 to prepare the ink discharge surface as shown in FIG. 17. In order to form an irregular surface at the peripheral parts around the discharge opening of an ink jet recording head, a diamond cutting grinding stone with a diamond grain size ranging from 10 μm to 30 μm is used for the grinding of the ink discharge surface, whereby a substantially uniform, pear-like irregular surface having a surface roughness R (average difference in the height between the top of convex part and the bottom of concave part) of 0.5 μm to 3 μm was formed. In this manner a plurality of ink jet recording heads were prepared and the ink discharge surfaces of the ink jet recording heads were surface-treated in the same manner as in the foregoing example. The surface treating agent was secured to the ink discharge surfaces through the irregularity on the surfaces and the surface treating agent layer as shown in FIG. 17 was formed.

Since a surface-treating agent retained in a porous material as a support is transferred to the ink discharge surface with a predetermined surface roughness of an ink jet recording head, as explained above, the surface-treating agent can be readily and uniformly transferred onto the ink discharge surface without entering of the surface treating agent into the discharge opening and deposition of the surface-treating agent onto the inside thereof.

Likewise, a plurality of ink jet recording heads with ink discharge surfaces having a surface roughness R of 5 μm to 10 μm were surface-treated in the same manner as in Examples 1 and 2. Substantially uniform surface-treating agent layers could be formed on the ink discharge surfaces without deposition of the surface treating agent at the inside of the discharge openings.

Surface treatment of an ink jet recording head can be continuously and uniformly carried out in example 8 and a good adhesion can be obtained between the surface-treating layer and the ink discharge surface, thereby preventing the surface-treating layer from peeling off.

According to a third embodiment of the present invention, a material capable of swelling with a liquid surface-treating agent is used as a support under a temperature condition for forming the surface-treating agent layer on the support during the surface treatment. As such a swellable material, materials capable of swelling only with a liquid surface-treating agent and establishing a swelling equilibrium with the surface-treating agent can be used and include, for example, fluorine rubber, NBR, polysulfide rubber, silicone rubber, etc.

EXAMPLE 9

In this example, an ink jet recording head with a structure as shown in FIGS. 1A and 1B was prepared in the following manner. That is, a thin glass tube with an inner diameter of 600 μm was narrowed at one end to form a discharge opening 5 with an inner diameter of 100 μm, and the other end of the thin glass tube was connected to a polyethylene tube 7 to supply an ink thereto from a tank (not shown in the drawings). Furthermore, a cylindrical piezo device 6 was inserted around the thin glass tube at a position near the discharge opening, as shown in FIGS. 1A and 1B and fixed to the thin glass tube with an adhesive (not shown in the drawings).

A surface treatment was applied to the thus prepared ink jet recording head 1 in the following manner.

Figure 18A:
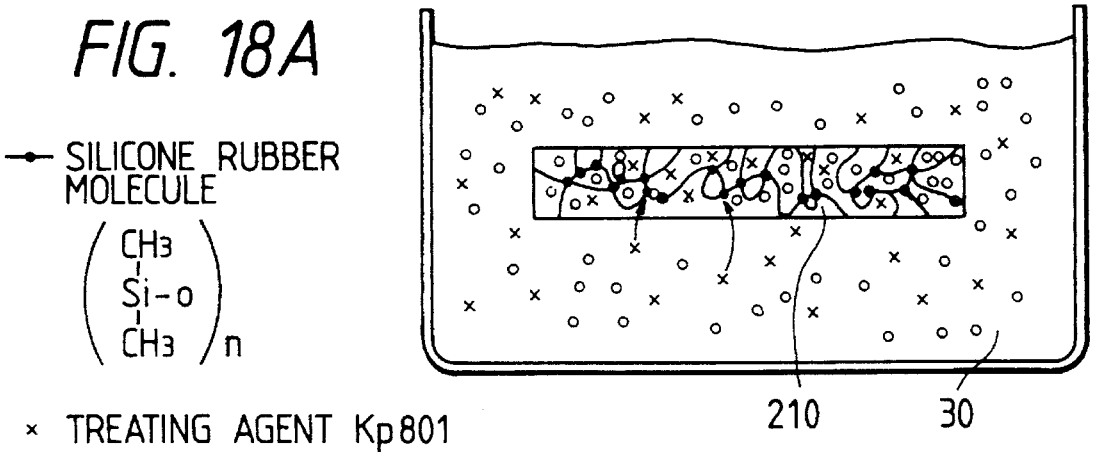
FIGS. 18A and B are a schematic view explaining the surface treatment according to the present invention.

At first, a plate member of silicone rubber as an elastomer (for example, SH841U, trademark of a product made by Toray K.K. Japan) was used as a transfer support 210, as shown in FIG. 18 and the support 210 was dipped in a solution of fluorosilicone type KP-801 (trademark of a product made by Shinetsu Kagaku Kogyo K.K, Japan) as a surface-treating agent 30 in a fluorine-based solvent, Daiflon Solvent S3 for 10 minutes or more, as shown in FIG. 18A and made to swell. It is believed that the solvent of the surface-treating agent solution 30 was permeated into the clearances among the molecules of silicone rubber support 210 in this state and kept in an equilibrium state and the surface-treating agent in the solution 30 is also permeated into the silicone rubber support at the same time.

That is, the surface-treating substance and the solvent were uniformly distributed in the silicone rubber.

Figure 18B:
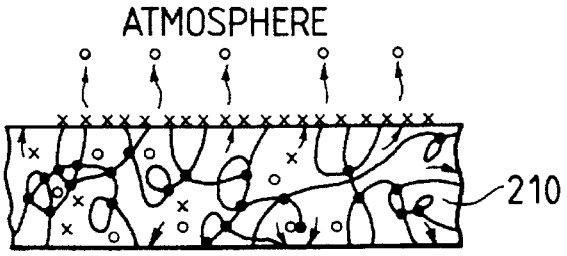
Figure 19A:
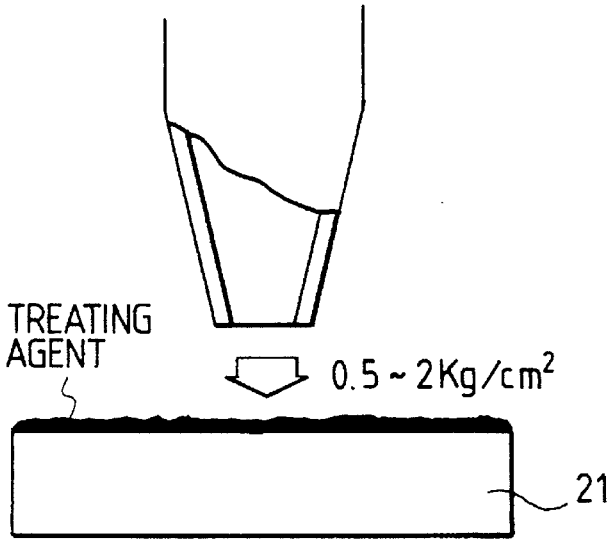
FIGS. 19A, 19B and 19C are a schematic view explaining the surface treatment according to the present invention.
Figure 19B:
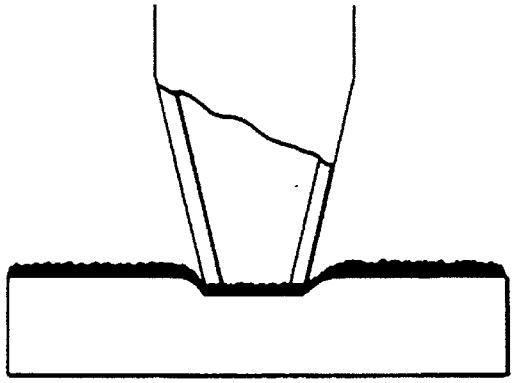
Figure 19C:
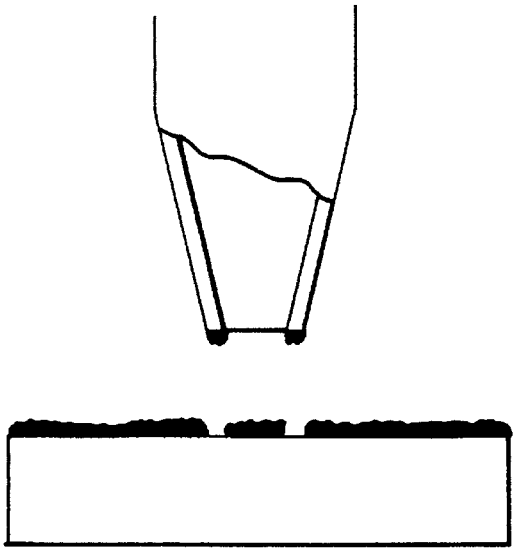

Then, the support 210 was pulled up from the solution and left standing in the atmosphere to evaporate off the solvent, as shown in FIG. 18B. At this time, the surface-treating permeated into the silicone rubber was gradually brought to the outside again, and only the solvent was evaporated off at the surface of the silicone rubber. As a result, only an uniform thin layer of the surface-treating agent was left on the surface of support 210. Then, the discharge opening 5 of the ink jet recording head 1, as shown in FIGS. 1A–1B, was pressed on the surface of the support 210 under a pressure of about 0.5 to 2 kg/cm$^2$ for a few seconds, as shown in FIGS. 19A, 19B and 19C to transfer the surface-treating agent only onto the peripheral parts of the discharge opening 5-1 in contact with the thin layer on the silicone rubber. Then, the ink jet recording head 1 was dried at 150° C. for 2 hours.

As a silicone rubber for use as support 210, those that can cause swelling with a surface-treating agent (solvent in this example) and can undergo only swelling according to the swelling equilibrium equation as proposed by Flory with the surface-treating agent can be used. Those which cause an abnormal swelling with the surface-treating agent to break the three-dimension reticular structure or cross linking or cause extraction, etc. cannot be used in this example.

By the swelling equilibrium, the concentration distribution of the solvent can be kept constant and uniform within the support 210, and thus the thin layer of a surface-treating agent can be constantly and uniformly formed. Furthermore, the thickness of the thin layer of a surface-treating agent can be readily controlled by controlling the concentration of a solution of a surface-treating agent.

EXAMPLE 10

In this example, a support of the same material as in Example 9 was used and dipped in the same solution of surface-treating agent as in Example 9 and immediately pulled up from the solution to form a thin layer of the solution of a surface-treating agent (in this example, the surface-treating substance and the solvent) on the surface of the suport. By evaporating only the solvent off the thin layer, a thin layer of the surface-treating agent was formed. Then, the surface-treating agent was transferred onto the ink discharge surface of an ink jet recording head and dried in the same manner as in Example 9

In this example it is to be noted that the thickness and uniformity, of a thin layer of a surface-treating agent largely depend upon the pull-up speed of a support from the solution of the surface-treating agent. That is, when the pull-up speed of a support is higher than the evaporation rate of a solvent, a liquid pool is formed on the surface of the support, causing an uneven thin layer. When the pull-up speed of the support in lower than the evaporation rate of the solvent on the other hand, the thin layer tends to become thicker with a lower pull-up speed, though the uniformity of the thin layer can be obtained.

Thus, it is possible to form a uniform thin layer of a surface-treating agent on a support by controlling the concentration of the surface-treating agent in solution by the method of this example, but it is necessary for controlling the thickness of the thin layer to control the pull-up speed of the support, besides the concentration of the surface-treating agent in solution.

EXAMPLE 11

The present invention is applicable to an ink jet recording head whose peripheral parts around the discharge openings are made of at least two different materials, as shown in FIGS. 1C–1E, under the same conditions as in Example 9.

Figure 20A:
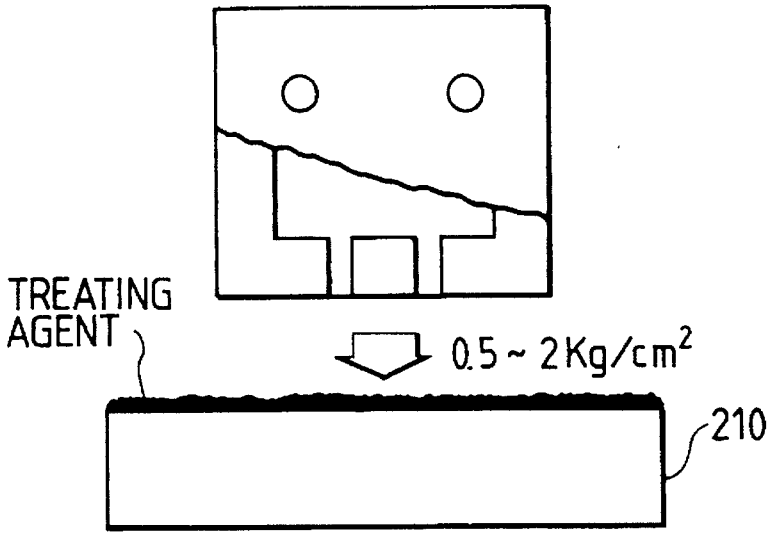
FIGS. 20A, 20B and 20C are a schematic view explaining the surface treatment according to the present invention.
Figure 20B:
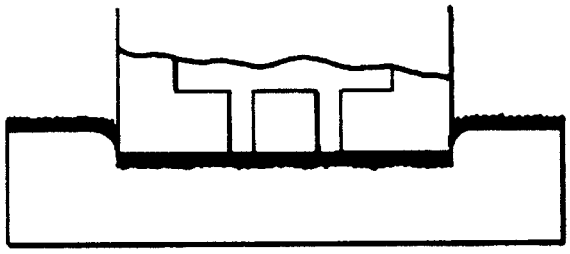
Figure 20C:
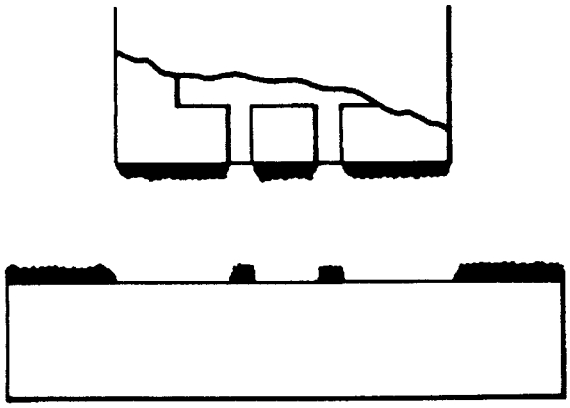

FIGS. 20A, 20B, and 20C show a process for transferring a surface-treating agent onto a support formed from the same materials under the same conditions for forming the thin layer of the surface-treating agent as in Example 9. The thus obtained ink jet recording head, when used after drying, can have the same preferable effect as in Example 9, and also can have the same effect as in Example 10 when tested even under the same conditions as in Example 10.

In the foregoing Examples, silicone rubber was used as a support, but the present invention is not limited thereto. That is, fluorine rubber, NBR, polysulfide rubber, etc. can be used as a support, so long as they can attain the swelling equilibrium with the surface-treating agent. The present invention is most suitable to the surface treatment of an ink jet recording head with a large number of discharge openings, for example, a multi-orifice consisting of several hundred to several thousand orifices.

In the method for surface-treating the ink discharge surface including a discharge opening of an ink jet recording head as shown in the foregoing Examples 9 to 11, a thin film of a surface-treating agent is uniformly formed on the surface of a support made of material capable of swelling with the surface-treating agent and the thin layer is transferred to the ink discharge surface of the ink jet recording head. Thus, only the ink discharge surface (peripheral parts) can have an ink liquid repellency and the discharge of ink can be made stably without any deviation of the direction of discharging the ink, thereby improving the quality of printed letters and images.

The present method is so simple that an ink jet recording head can be readily produced at a low cost.

EXAMPLE 12

Figure 21:
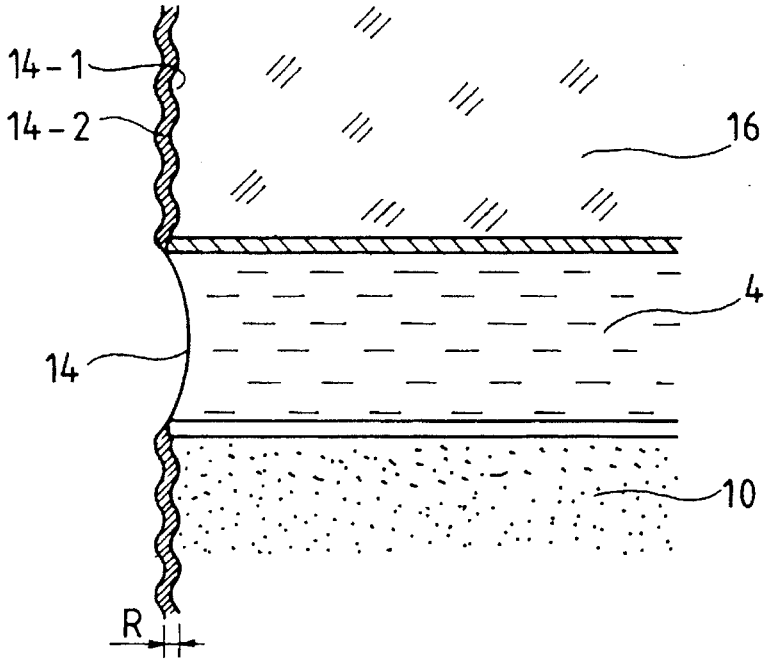
FIG. 21 is a schematic cross-sectional view of an ink jet recording head, which explains the surface treatment according to the present invention.

In this example an ink jet recording head with the same structure as shown in FIGS. 1C to 1E was used, and the ink discharge surface 51 was further processed by cutting and Grinding with a diamond blade 25 having a grain size of, for example, about 8 μm (#2,500), as shown in FIG. 5 to form a pear like surface of fine irregularity (surface roughness R=5 μm). A surface-treating agent on a support prepared in the process shown in FIG. 18 was transferred onto the thus further processed ink discharge surface 14-1 of the ink jet recording head by a transfer process shown in FIGS. 20A, 20B and 20C, whereby a surface-treating layer 14-2 was formed on the ink discharge surface 14-1, as shown in FIG. 21. In this example, the surface-treating agent was strongly secured to the ink discharge surface 141 as a rough surface through capturing into the fine concave parts when transferred, and thus the surface-treating agent can be readily transferred onto the ink discharge surface without entering into the discharge openings 14. Thus, an uniform, ink repellent surface treatment can be carried out on the surface 14-1 including the discharge openings 14 of an ink jet recording head.

According to a fourth embodiment of the present invention, a surface-treating agent is transferred onto the ink discharge surface of an ink jet recording head by use of a support of a predetermined surface roughness (average difference r height between the top of convex part and the bottom of concave part).

The fourth embodiment of the present invention will be explained in detail below, referring to Examples 13 to 15.

Support materials for use in these examples are those which can form an irregularity on the surface on which a thin layer of a surface-treating agent is formed, and include, for example, non elastomers such as glass, metals, ceramics, wood, non elastic plastics, etc. and elastomers such as rubber, elastic plastics, etc., among which those which can readily form the irregularity and are deformable, particularly, elastomers, are preferable.

The irregularity includes a stripe pattern, a spiral pattern, etc., and preferably is a pattern in which at least either concave parts or convex parts are not in a continuous state. Specifically, the support materials are silicone rubber, fluorine rubber, NBR, polysulfide rubber, film materials, etc.

The surface roughness r of a support (average difference in height between the top of convex part and the bottom of concave part) is appropriately selected so that the surface-treating agent may not enter into the discharge opening when transferred, and preferably is 0.01 μm to 0.5 μm.

The fourth embodiment of the present invention will be described in detail below, referring to the drawings.

EXAMPLE 13

In this example, an ink jet recording head with a structure as shown in FIGS. 1A and 1B was prepared and washed with methylethylketone (MEK) and then Daiflon S3 (trademark of a product made by Daikin Kogyo K.K., Japan) each for 5 minutes and then washed in an UV ozone washer for 3 minutes to clean the peripheral parts of the discharge opening.

Figure 22A:
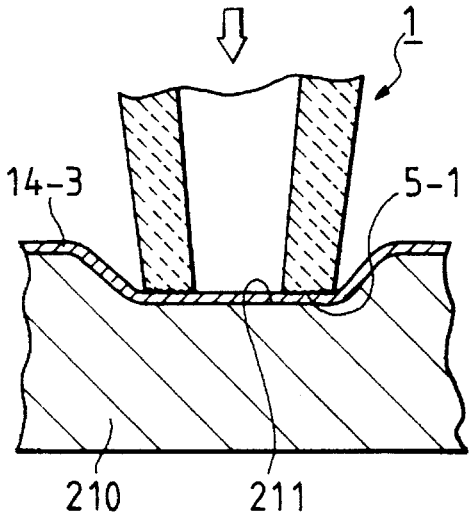
FIGS. 22A and 22B are schematic views explaining the surface treatment according to the present invention.
Figure 22B:
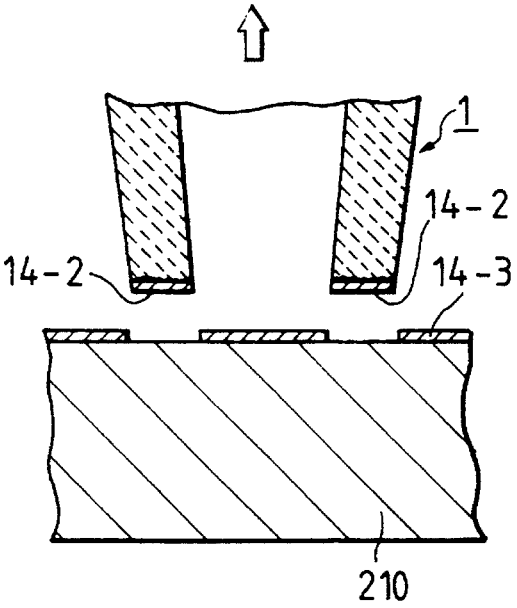

On the other hand, an elastomer plate made of thermoplastic polyester elastomer Hitorayl (trademark of product made by Toray-DuPont K.K., Japan) having a thickness of 2 mm was surface processed as a support to give a surface roughness r (average difference in height between the top of convex part and the bottom of concave part) of 0.01 μm. Then, the support was dipped in a Daiflon S3 solution containing 1 wt. % of a fluorosilicon-based water repelling agent KP801 (trademark of a product made by Shinetsu Kagaku K.K., Japan) as a surface-treating agent and then pulled up therefrom. The solvent Daiflon S3 was evaporated off from the support to form a thin layer of the surface-treating agent on the surface of the support. In FIGS. 22A and 22B numeral 210 is the support and 14-3 is a thin film of the surface-treating agent.

Then, the surface of the ink jet recording head 1 was surface processed with a diamond cutting grinding stone having a diamond grain size of 10 μm to give a surface roughness R (average difference in height between the top of convex part and the bottom of concave part) of 0.5 μm. Then, the ink discharge surface 5-1 of the ink jet recording head 1 was pressed on the support with the thin layer 14-3 of the surface-treating agent from the overhead, as shown in FIG. 23A to transfer the thin layer 14-3 onto the ink discharge surface 5-1 of the ink jet recording head 1, as shown in FIG. 22B.

In this example, an elastomer is preferable as a support for the transfer of the thin layer 14-3, because in case of an elastomer a force is uniformly applicable to the ink discharge surface when the ink jet recording head 1 is pressed on the thin layer 14 3, as shown in FIG. 22A, and consequently uneven transfer of the thin layer 14-3 of the surface-treating agent can be prevented on the ink discharge surface 5-1 of the ink jet recording head 1. Furthermore, it is preferable to process the surface 211 of the support 210 and use the support whose surface roughness r is equal to or less than the surface roughness R of the peripheral parts around the discharge opening, that is, $r \leqq R$. Uneven transfer of the thin layer 14-3 can be completely prevented thereby when the thin layer 14-3 is transferred onto the ink discharge surface 5-1, as shown in FIG. 22B. The elastomer herein referred to is a material having a Young's modulus E of $10^2$ to $10^{-1}$ MPa.

After the transfer of the thin layer, the ink jet recording head 1 was heated at 150° C. for 2 hours to cure the surface-treating agent through reaction. Thus, the surface-treating agent layer 14-2 having a substantially uniform thickness could be strongly bonded to the ink discharge surface 5-1 of the ink jet head 1.

Figure 23:
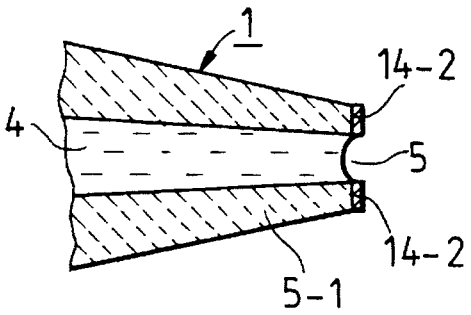
FIG. 23 is a schematic cross-sectional view of an ink jet recording head, which explains the surface treatment according to the present invention.
Figure 24:
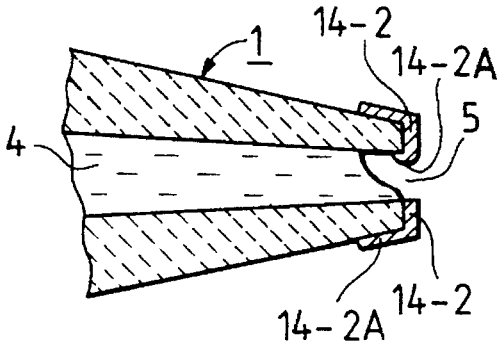
FIG. 24 is a schematic cross-sectional view of an ink jet recording head, which explains the surface treatment according to the prior art.

As a result, the surface-treating layer 14-2 was formed only on the ink discharge surface 5-1 of the ink jet recording head 1, as shown in FIG. 23, and the state of meniscus formed at the discharge opening 5 could be maintained normal, as will be described later. When a surface treating agent layer was formed on the ink discharge surface of an ink jet recording head in a conventional manner, as will be described later, on the other hand, the surface-treating agent was deposited on the inside of the discharge opening, as shown by 14-2A in FIG. 24, and the normal meniscus state could not be maintained at the orifice 5.

EXAMPLE 14

In this example, a smoothly surface-finished plate made of fluorine rubber of ethylene tetrafluoride-propylene copolymer, Afrate 150 (H-70) (trademark of a product made by Japan Synthetic Rubber Co., Japan) having a thickness of 2 mm and surface roughness r of 0.5 μm was used as a support, and the ink discharge surface of an ink jet recording head was roughened with a diamond cutting grinding stone having a diamond grain size of 30 μm to give a surface roughness R of 3 μm. By transferring the same surface-treating agent in the same manner as described in Example 13, an ink jet recording head having the same effect as in Example 13 could be obtained.

The following Table 2 shows comparative observation results of the ink jet recording heads prepared by the surface treatment methods of Examples 13 and 14 (samples 8 and 9) and a comparative ink jet recording head the ink discharge surface of which was surface treated by filling pure water in the nozzle and then dipping the ink jet recording head into a fluorosilicon-based water repelling agent as the surface treating agent (sample 7).

TABLE 2

| | Surface treatment method | Result of formed meniscus observation |
|---|---|---|
| Sample 7 | Surface treatment based on filling of pure water into the nozzle and dipping of the recording head in a fluorosilicone-based water-repelling agent according to the conventional art | 6 recording heads were surface treated and poor ink meniscus was formed on the three recording heads |
| Sample 8 | Hitorayl was used as a transfer support according to the invention | 6 recording heads were surface-treated and good ink meniscus was formed on all the six recording heads |
| Sample 9 | Afrate was used as a transfer support according to the invention | Same as that of Sample 8 |

EXAMPLE 15

Figure 25:
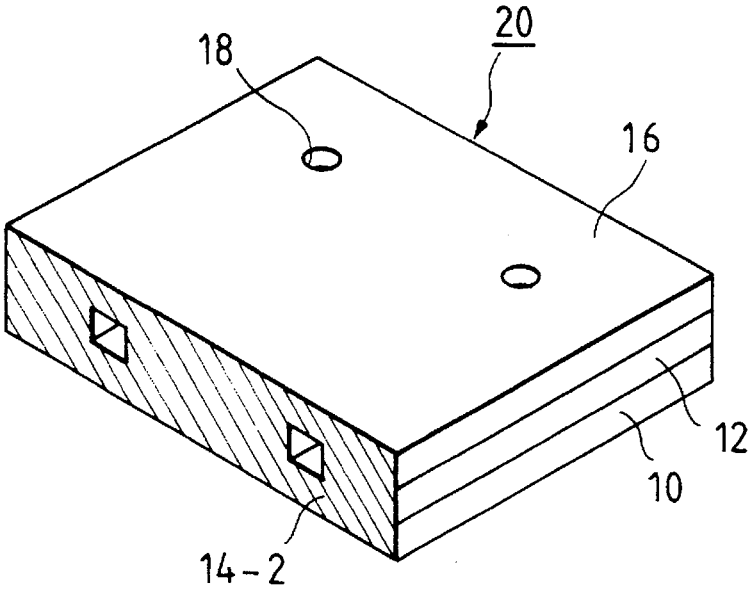
FIG. 25 is a schematic perspective view of an ink jet recording head, which explains the surface treatment according to the present invention.

FIG. 25 shows that a surface-treating layer 14-2 was formed on the ink discharge surface of an ink recording head in the form shown in FIGS. 1C to 1E. That is, in this example, an ink jet recording head 20 is often made of a combination of different materials at the peripheral parts of discharge openings 14 and thus the ink discharge surface must be particularly carefully surface-treated.

Figure 26A:
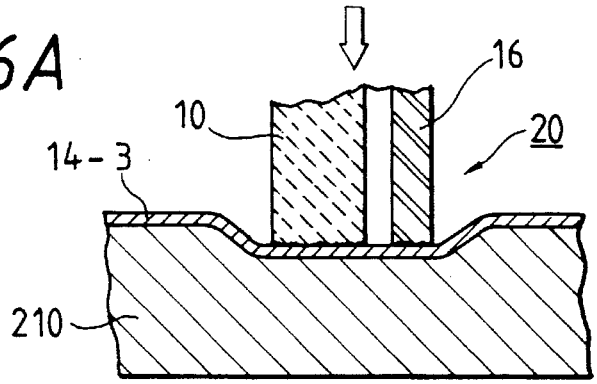
FIGS. 26A and 26B are schematic views explaining the surface treatment according to the present invention.
Figure 26B:
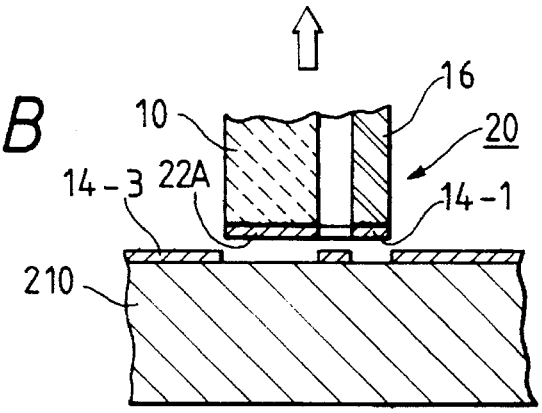

In this example, cleaning of the ink discharge surface and formation of a surface-treating agent layer on an elastomer support 210 were carried out in the same manner as in Examples 13 and 14 and a thin layer of a surface treating agent was transferred onto the ink discharge surface 14-1, as shown in FIGS. 26A and 26B. In this example, the ink discharge surface 14-1 was surface-finished to a surface roughness R of 3 μm in the same manner as in Examples 13 and 14 and the support 210, on which the thin layer of a surface-treating agent was formed, was surface-finished to a surface roughness r equal to or less than the surface roughness R of the ink discharge surface, specifically, 0.01 μm in this example.

Figure 27:
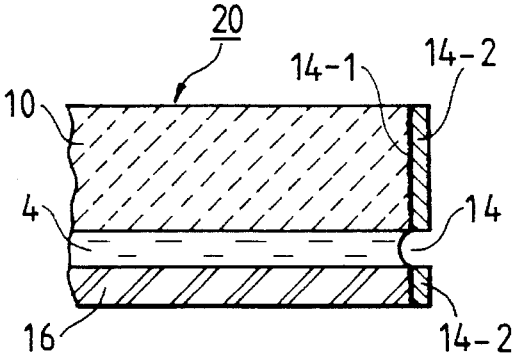
FIG. 27 is a schematic cross-sectional view of an ink jet recording head, which explains the surface treatment according to the present invention.
Figure 28:
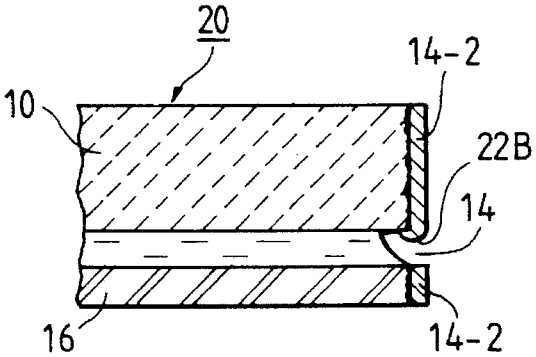
FIG. 28 is a schematic cross-sectional view of an ink jet recording head, which explains the surface treatment according to the prior art.

As a result, the surface-treating agent layer 14-2 could be normally transferred and formed only on the ink discharge surface 14-1 without deposition of the surface-treating agent at the inside of the discharge opening 14, as shown in FIG. 27, and no abnormal meniscus state at the discharge opening as shown in FIG. 28 as the conventional art was observed at all. A comparative observation of the formation of a surface-treating layer according to this example and that according to the conventional art was carried out in the same manner as in Examples 13 and 14 and it has been found that the substantially same results as in Table 2 were obtained.

In the foregoing Examples 13 to 15, stable ink discharge in a desired direction can be always carried out by the thus prepared ink jet recording head and the present invention is suitable for preparing an ink jet recording head for high speed recording. Furthermore, the present surface treatment method is so simple that an ink jet recording head can be prepared at a low cost. The present invention is thus suitable for a mass production.

According to a fifth embodiment of the present invention, transfer of a surface-treating agent onto an ink jet recording head is carried out with a support having a specific surface irregularity pitch.

EXAMPLE 16

Figure 29A:
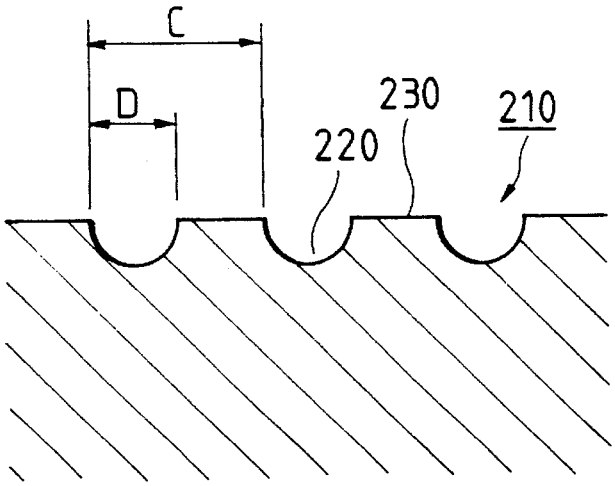
FIGS. 29A and 29B are schematic views explaining a support for use in the surface treatment according to the present invention.
Figure 29B:
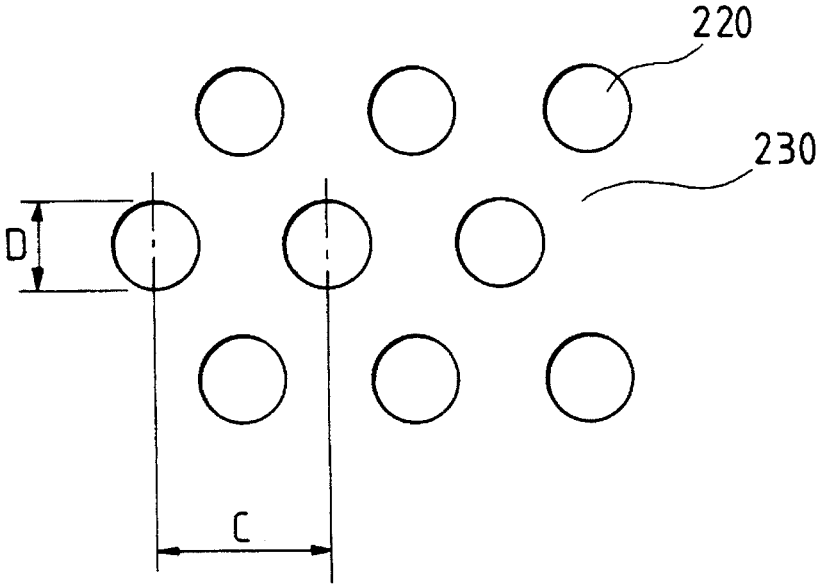

FIGS. 29A and 29B show one structure of a plate-form or sheet-form transfer support as a support for use in this example.

At first, an ink jet recording head with the same structure as in FIGS. 1A and 1B was prepared in the following manner.

That is, a thin glass tube having an inner diameter of 700 μm was narrowed at one end to form an ink discharge opening 5 having an inner diameter of 100 μm. The other end of the thin glass tube was connected to a polyethlene tube to supply an ink thereto from an ink tank (not shown in the drawings). Furthermore, a cylindrical piezo device 6 was inserted around the outside of the thin glass tube at a position near the discharge opening 5, as shown in FIGS. 1A and 1B and fixed thereto with an adhesive (not shown in the drawings). The thus prepared ink Jet recording head was surface treated in the following manner.

At first, a photosensitive unsaturated polyester (for example, APR, trademark of a product made by Asahi Kasei Kogyo K.K., Japan) as an elastomer was processed into a shape having concave parts 220 and convex parts 230, as shown in FIGS. 29A and 29B by conventional photolithography.

An irregularity pitch C, a distance between the centers of adjacent two round indents as concave parts as shown in FIGS. 29A and 29B, was set to about 50 μm, which corresponded to approximately one-half of the diameter of the discharge opening 5 (100 μm) and the diameter D of the round indent was set to about 25 μm, which corresponded to approximately one half of the pitch C.

Then, a water-repelling agent (for example, KP-801, trademark of a fluorosilicon-based agent by Shinetsu Kagaku Kogyo K.K., Japan) as an ink-repellent, surface-treating agent was uniformly sprayed onto the surface of the support 210 by a spray, and then the surface-treating agent in excess was scraped by travelling a metallic squazee or a knife along and in contact with the surface of the support 210. Most of the surface-treating agent existed in the concave parts 220 in this state, and a portion thereof remained on the convex parts 230.

Figure 30:
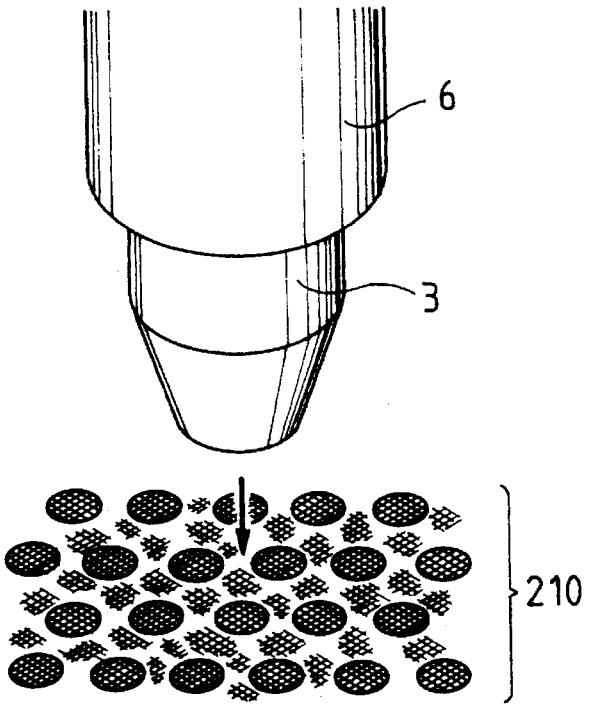
FIG. 30 is a schematic view explaining the surface treatment according to the present invention.

Then, the ink discharge surface 5-1 as the peripheral parts of the discharge opening 5 of the ink jet recording head 1 was pressed on the thus prepared support 210 under a pressure of, for example, about 2 kg/cm$^2$ for a few seconds, as shown in FIG. 30, whereby mainly the surface-treating agent in a liquid state existing in the concave parts 220 of the support 210 was transferred onto the ink discharge surface of the ink jet recording head 1. Thus, the ink jet recording head was dried at about 150° C. for 2 hours, whereby the surface-treating agent was strongly fixed to the ink discharge surface of the ink jet recording head 1. In this manner, the ink jet recording head 1 was surface treated.

After the drying, the ink discharge surface 5-1 was observed, and it has been found-that the surface-treating agent was almost uniformly transferred only onto the ink discharge surface 5-1 around the discharge opening 5 to form a surface-treating agent layer 14-2.

Preparation of comparative sample

Figure 32A:
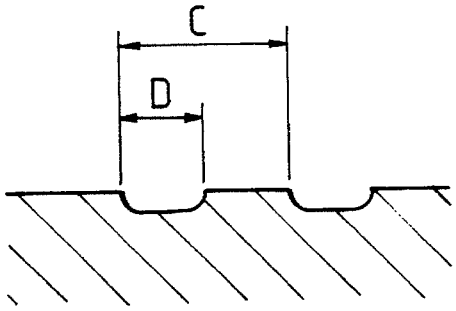
FIGS. 32A and 32B are a schematic view explaining a support for use in the surface treatment according to the present invention.
Figure 32B:
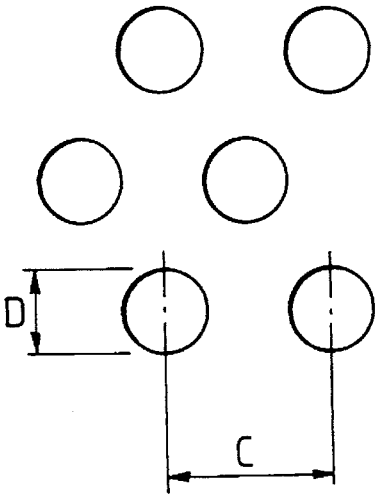

In order to make comparison with the ink jet recording head of Example 16, an irregularity pattern of concave parts and convex parts having sizes shown in FIGS. 32A and 32B were formed on the surface of a support made of the same material as in Example 16. The distance C between the centers of two adjacent round indents (pitch between the concave part and the convex part) in FIGS. 32A and 32B was about 100 μm, which was approximately equal to the opening diameter of the discharge opening 5 (about 100 μm), and the diameter D of the round indent was about 50 μm, which was one half-of the pitch C. An ink repellent, surface-treating agent layer was formed on the surface of the support in the same manner as in Example 16 and the ink discharge surface of an ink jet recording head 1 was pressed on the surface of the support under a pressure of about 2 kg/cm$^2$ for a few seconds in the same manner as in Example 16 to transfer the surface-treating agent onto the ink discharge surface of the ink jet recording head 1. The same surface-treating agent as in Example 17 was used. Then, the ink jet recording head 1 was dried at 150° C. for 2 hours.

After the drying, the peripheral parts of the discharge opening 5 was inspected and it was found that there were regions 14-4 with no deposition of the surface-treating agent at the ink discharge surface 5-1 of the discharge opening 5 and thus the surface-treating agent was not uniformly transferred onto the ink discharge surface 5-1.

Thus, a better result was obtained in the surface treatment according to Example 16 than by the comparative sample, and it was found that the transfer of a surface-treating agent largely depended upon the size of irregularity pitch on the surface of support 210.

EXAMPLE 18

Figure 34A:
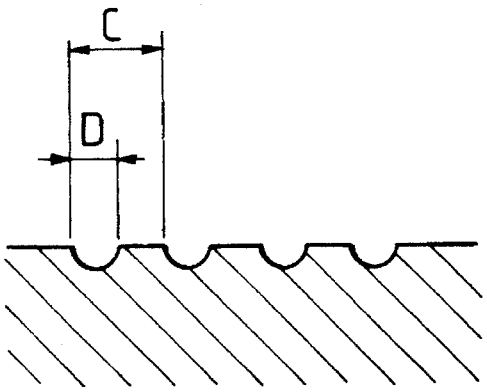
FIGS. 34A and 34B are a schematic view explaining a support for use in the surface treatment according to the present invention.
Figure 34B:
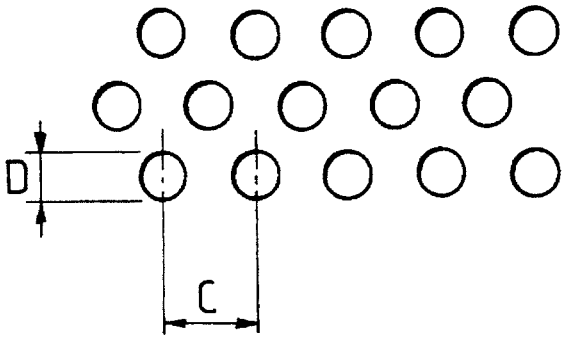

In this example, an irregularity pattern shown in FIGS. 34A and 34B was formed on the surface of a support made of the same material as in Example 17. The distance C between the centers of the two adjacent round indents (pitch between the concave part and the convex part) in FIGS. 39A and 39B was about 25 μm, which was approximately one fourth of the opening diameter of discharge opening 4 and the diameter D of the round indent was 10 to about 15 μm, which was approximately one-half of the pitch C.

Figure 31:
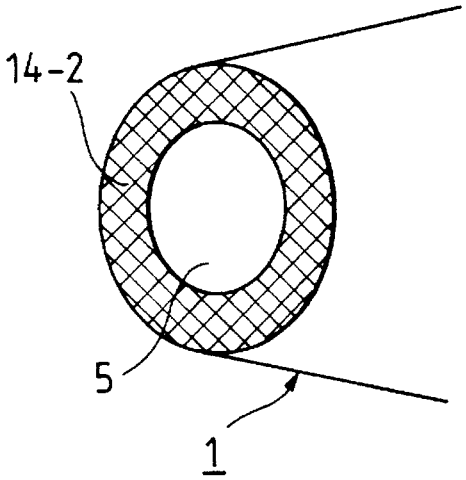
FIG. 31 is a schematic view of an ink jet recording head, which explains the surface treatment according to the present invention.
Figure 33:
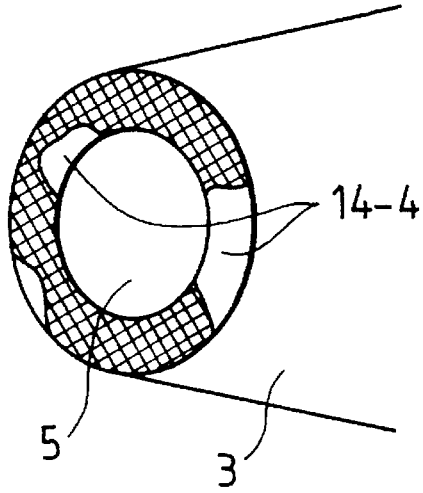
FIG. 33 is a schematic view showing an ink jet recording head with a poor surface treatment.

An ink-repellent, surface-treating agent layer was formed on the surface of the support in the same manner as in Example 16, and the ink discharge surface of an ink jet recording head 1 was pressed on the surface-treating agent layer on the support under a pressure of about 2 kg/cm$^2$ for a few seconds in the same manner as in Example 16 to transfer the surface-treating agent onto the ink discharge surface of the ink jet recording head. The same surface-treating agent as in Example 16 was used. Then, the ink jet recording head 1 was dried at 150° C. for 2 hours. After the drying, the peripheral parts of the discharge opening 5 were inspected and it was found that the surface-treating agent was uniformly transferred onto the ink discharge surface of the ink jet recording head, similarly as shown in FIG. 31.

Comparison of samples 10 and 12 prepared according to Example 16 and 18, respectively with comparative samples 11 and 13:

The recording heads 1 prepared according to Examples 16 and 18, i.e. samples 10 and 12, respectively, and the comparative recording head 1, i.e., sample 11, were actually driven to examine an angle of deviation from the predetermined direction of discharging ink droplets and number of occurrence of discharge-failing heads during a continuous driving for one hour. The results are shown in Table 3. The driving results of an ink jet recording head without the surface treatment with the ink-repellent, surface-treating agent are shown together in Table 3 as comparative sample 13.

TABLE 3

| | Number of tested heads, | Angle of deviation from the predetermined discharge direction | | | Number of occurrence of discharge-failed heads during continuous | Overall |
|---|---|---|---|---|---|---|
| | n | max. | min. | average | driving for one hour | evaluation |
| Sample 10 | n = 20 | 1° | 0° | 0.2° | 0 | ⊙ |
| Sample 11 | n = 20 | 12° | 3° | 7° | 3 | X |
| Sample 12 | n = 20 | 1° | 0° | 0.3° | 0 | ⊙ |
| Sample 13 | n = 20 | 15° | 2° | 9° | 4 | X |

In case of the ink jet recording head without the surface treatment, i.e., sample 13, the ink was gradually deposited on the ink discharge surface 5-1 of the discharge opening 5 and the deviation of the ink discharge direction was considerable. Upon examination of 20 samples 13, the angle of ink discharge deviation from the predetermined direction was found to be 15° at the maximum, 2° at the minimum and 9° on the average. Furthermore, after a continuous driving for one hour, 4 of 20 samples 13 failed to discharge the ink. The ink was deposited thick on the entire ink discharge surface 5-1 of the discharge opening of these four discharge-failed ink jet recording heads.

In case of samples 10 and 12 according to Examples 16 and 18, respectively, the angle of deviation of ink discharge direction from the predetermined direction was very small, as shown in Table 3, and even after a continuous driving for one hour, the ink discharge surface 5-1 of the discharge opening 5 was not wetted with the ink at all and a good ink repellency was obtained. Furthermore, there was no discharge-failed ink jet recording head at all.

However, in case of sample 11 with larger irregularity shape and pitch on the support surface, no improvement was observed at all, as compared even with sample 13 without the surface treatment, and there was no significant difference from sample 13 without the surface treatment in the angle of deviation of ink discharge direction from the predetermined direction and the number of occurrence of discharge-failed ink jet recording heads after a continuous driving for one hour. It is believed that causes for the poor results of sample 11 are that 1) too large an amount of the surface-treating agent is retained in the concave parts because of too large a pitch between the concave part and the convex part on the support surface, and thus a portion of the surface-treating agent is not only deposited on the ink discharge surface 5-1 of the discharge opening 5, but also enters into the discharge opening 5 in the transfer of the surface-treating agent and 2) the pitch between the concave part and the convex part on the support surface is too large, e.g., 100 μm, as compared with the opening diameter of the discharge opening, e.g., 100 μm, and consequently a larger amount of the surface treating agent is retained in the concave parts, whereas there is substantially no surface-treating agent at some of the convex parts, with the result that the ink discharge surface 5-1 of the discharge opening is liable to have non-transferred regions of the surface-treating agent and the non-transferred regions are covered with the ink, whereby the ink discharge direction is considerably deviated from the predetermined direction.

It has been found as a result of the foregoing actual driving test that the irregularity pitch, i.e., a pitch between the concave part and the convex part, on the support surface is preferably not more than one-half of the opening diameter of the discharge opening, as shown in Examples 16 and 18.

EXAMPLE 19

Figure 35:
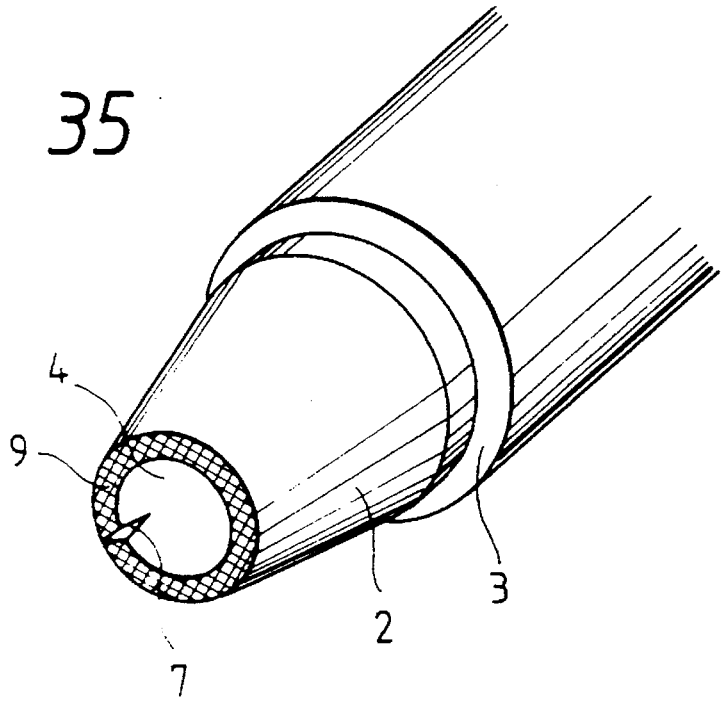
FIG. 35 is a schematic view showing an ink jet recording head with a defect.

FIG. 35 shows an ink jet recording head of this example.

In this example, an ink jet recording head having a small nick defect 5-1 on the ink discharge surface shown in FIG. 35 was surface treated in the same manner as in Example 18. The ink jet recording head with such a small nick defect without the surface treatment, sample 14 and that with the surface treatment, sample 15, were actually driven to examine an angle of deviation of the ink discharge direction from the predetermined direction and the number of occurrence of discharge failed samples during a continuous driving for one hour. The results are shown in the following Table 4.

TABLE 4

| | Number of tested heads, | Angle of deviation from the predetermined discharge direction | | | Number of occurrence of discharge-failed heads during continuous | Overall |
|---|---|---|---|---|---|---|
| | n | max. | min. | average | driving for one hour | evaluation |
| Sample 14 | n = 20 | 16° | 3° | 9° | 8 | X |
| Sample 15 | n = 20 | 5° | 0° | 2° | 1 | ⊙ |

As is evident from Table 4, sample 14 without the surface treatment of the present invention has a large angle of deviation, such as 3° to 16° (9° on the average) and the number of occurrence of discharge-failed heads during the continuous driving for one hour is 8, but sample 15 with the surface treatment of the present invention has an angle of deviation of 0° to 5° (2° on the average) and the number of occurrence of discharge-failed heads is only one. It seems that a cause for the improvement by the surface treatment of the present invention, even if the ink discharge surface has some flaws or nicks, is that such defect parts can be made ink-repellent by coating of a surface-treating agent and thus ink is not so much deposited thereon as to give an adverse effect upon the ink discharge, thereby preventing the ink discharge direction from deviation from the predetermined direction.

EXAMPLE 20

In this example, an ink jet recording head with a structure as shown in FIGS. 1C to 1E was prepared in the following manner.

Electro-thermal conversion devices 11 were provided on a first substrate 10 of silicon as an energy generator for use in the liquid discharge, and conductor wirings were provided at both ends of each of the electro-thermal conversion devices 11 to transmit a driving signal thereto, though not shown in the drawings. A cured film of a photo,sensitive resin was laminated upon the first substrate 10 and then discharge openings 14, liquid paths 13 and a liquid chamber 15 were formed thereon by a conventional photolithography. Furthermore, a second substrate 116 of glass provided with a liquid supply hole 18 was laid upon and bonded to the partition wall 12 of the cured film of a potosensitive resin through an adhesive 17 to complete an ink jet recording head. The dimension of square discharge opening 14 was about 100 μm in the lateral direction (subs/rate plane direction) and 80 μm in the longitudinal direction (direction perpendicular to the substrate).

Numeral 4 is an ink. The ink 4 was supplied to the liquid chamber 15 from the ink supply hole 18 and discharged as a liquid droplet from the discharge openings through the liquid paths 13. The discharged liquid droplets were deposited on a recording medium (paper). Discharge pressure for the liquid droplets was generated by heating the electrothermal conversion devices 11 rapidly and utilizing the pressure of bubbles formed on the devices 11. The ink jet recording head prepared in the foregoing manner was surface-treated in the same manner as in Example 17.

The same material and shapes of a support, irregularity pitch and processing conditions as in Example 17 and shown in FIGS. 29A and 29B were used.

Figure 36:
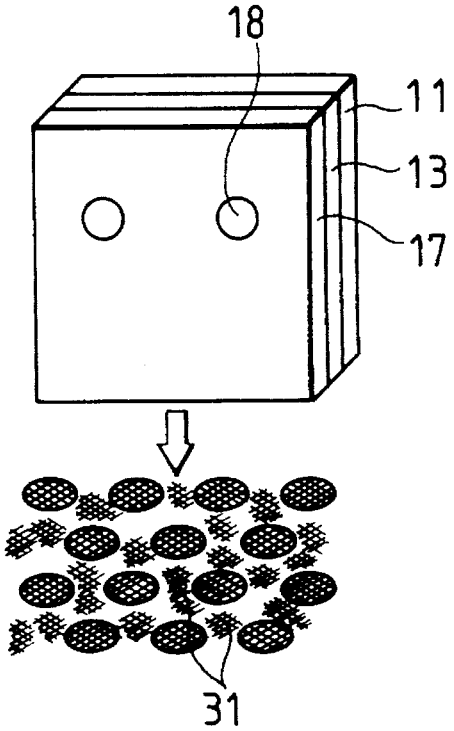
FIG. 36 is a schematic view explaining a support for use in the surface treatment according to the present invention.

The ink discharge surface of discharge openings 14 of the thus obtained ink jet recording head was pressed on the surface of the support under a pressure of about 2 kg/cm$^2$ for a few seconds from the overhead, as shown in FIG. 36, whereby mainly the surface-treating agent existing in the concave parts of the support was transferred onto the ink discharge surface of the ink recording head. Then, the ink jet recording head was dried at about 150° C. for 2 hours. After the drying, the peripheral parts around the discharge openings 14 were inspected and it was found that the surface-treating agent was almost uniformly deposited on the ink discharge surface 14-1 to form a surface-treating agent layer 14-2.

Preparation of comparative sample 17

In order to make comparison-with Example 20, an irregularity pattern of a dimension as shown in FIGS. 32A and 32B was formed on a support of the same material as in Example 20, where the distance between the two adjacent round indents C(pitch between the concave part and the convex part) was about 100 μm, which was almost equal to the opening diameter of the discharge opening 14 and the diameter D of the round indent was about 50 μm, which was one-half of the pitch C. A surface-treating agent layer was formed on the irregularity-patterned surface of the support in the same manner as in Example 20 and the ink discharge surface of the discharge openings 14 of an ink jet recording head with a structure as shown in FIGS. 1C to 1E was pressed on the surface of the support under a pressure of about 2 kg/cm$^2$ for a few seconds in the same manner as in Example 20 to transfer the surface-treating agent onto the ink discharge surface of the ink jet recording head. The same surface-treating agent as KP-801 (trademark of a product made by Shinetsu Kagaku Kogyo K.K., Japan) as in Example 20 was used. Then, the ink jet recording head was dried at 150° C. for 2 hours.

Figure 38:
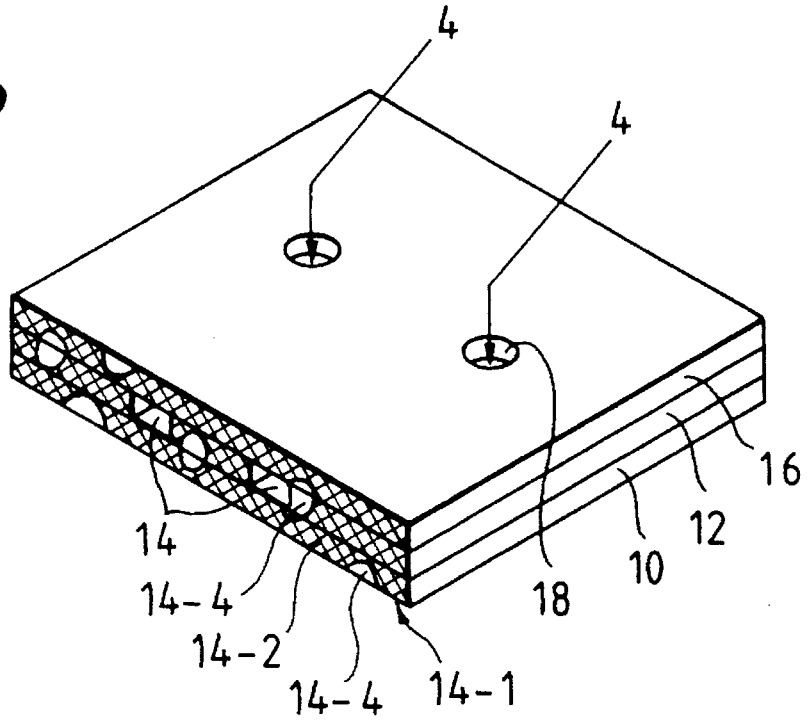
FIG. 38 is a schematic view showing an ink jet recording head as surface-treated according to a comparative example.

After the drying, the ink discharge surface was inspected and it was found that there were non-transferred regions of the surface-treating agent on the ink discharge surface around the discharge openings, as shown in FIG. 38 and thus the surface treatment was not uniformly carried out.

EXAMPLE 21

Figure 37:
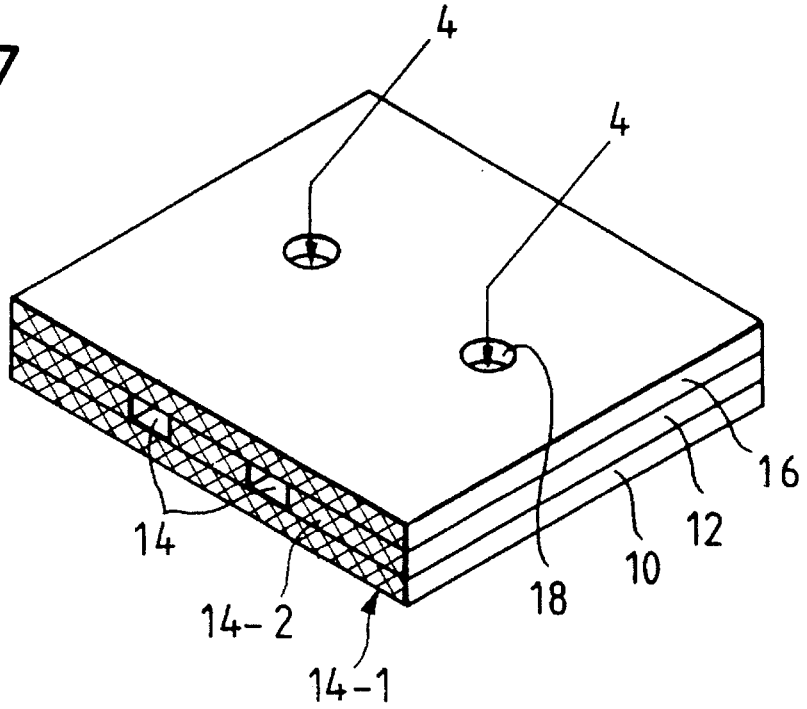
FIG. 37 is a schematic view showing an ink jet recording head as surface-treated according to the present invention.

In this example, a surface-treating agent layer was transferred onto the ink discharge surface of an ink jet recording head with a structure shown in FIGS. 1-C to 1-E by use of a support of the same shape and dimension as in FIG. 34 and Example 18, and dried, after the drying, the ink discharge surface was inspected and it was found that the surface-treating agent was uniformly adhered thereto as shown in FIG. 37.

Comparison of samples 16 and 18 prepared according to Examples 20 and 21, respectively, with comparative samples 17 and 19:

The ink jet recording heads prepared according to Examples 20 and 21, samples 16 and respectively, and comparative ink jet recording head, sample 17, were actually driven to examine an angle of deviation of the ink discharge direction from the predetermined direction and the number of occurrence of discharge failed heads during a continuous driving for one hour. The results are shown in the following Table 5. Results of an ink jet recording head without the surface treatment are shown together in Table 5 as comparative sample 19.

TABLE 5

| | Number of tested heads, | Angle of deviation from the predetermined discharge direction | | | Number of occurrence of discharge-failed heads during continuous | Overall |
|---|---|---|---|---|---|---|
| | n | max. | min. | average | driving for one hour | evaluation |
| Sample 16 | n = 20 | 1° | 0° | 0.2° | 0 | ⊙ |
| Sample 17 | n = 20 | 17° | 3° | 8° | 2 | X |
| Sample 18 | n = 20 | 1° | 0° | 0.3° | 0 | ⊙ |
| Sample 19 | n = 20 | 20° | 2° | 11° | 4 | X |

As is evident from the foregoing results, the present invention as embodied in Examples 20 and 21 is also applicable to the ink jet recording heads with a structure as shown in FIGS. 1-C to 1-E. That is, in case of the ink jet recording head without the surface treatment i. e. sample 19 ink was gradually deposited on the peripheral parts of the discharge outlets 14, particularly on the most ink wettable glass parts 17 and thus the deviation from the predetermined ink discharge direction was considerable. It was found that the angle of deviation from the predetermined ink discharge direction was 20° at the maximum, 2° at the minimum and 11° on the average upon the examination of 20 samples 19. Furthermore, 4 recording heads of 20 samples 19 failed to discharge the ink after a continuous driving for one hour. The ink was deposited thick on the entire peripheral parts of the discharge openings 14 of all the four samples 19.

In case of sample 16 according to Example 20 and sample 18 of Example 21, the angle of deviation from the predetermined ink discharge direction was very small, as shown in Table 5, and the peripheral parts of the discharge openings 14 were not wetted with the ink at all even after the continuous driving for one hour. Thus, samples 16 and 18 showed a good ink liquid repellency, resulting in no discharge failed ink jet recording head at all.

However, in case of sample 17 with only difference in the irregularity pattern on the support surface, no improvement was obtained, as compared with sample 19 without the surface treatment and there were no significant differences from sample 19 in the angle of deviation from the predetermined ink discharge direction and the number of occurrence of discharge failed ink jet recording heads during the continuous driving for one hour.

In a method for surface-treating an ink discharge surface, i.e. peripheral parts, of a discharge opening of an ink jet recording head as embodied in Examples 16–21, only the ink discharge surface of the discharge opening is made ink repellent by forming a thin layer of a surface-treating agent on the surface of a support having an irregularity pitch of not more than one half of the opening diameter of the discharge opening of the ink jet recording head and transferring the thin layer onto the ink discharge surface of the ink jet recording head, as described above, whereby the ink can be discharged stably without any deviation of the ink discharge direction and the quality of printed letters or images can be improved.

Furthermore, the present surface treatment method is so simple that an ink jet recording head can be readily prepared at a low cost. In addition, even if there are some flaws or nicks at the peripheral parts of the discharge opening, deviation of the ink discharge direction due to such defects can be remedied by the surface treatment according to the present invention and thus the present invention is also very effective for improving the yield of ink jet recording heads.

EXAMPLE 22

Figure 39A:
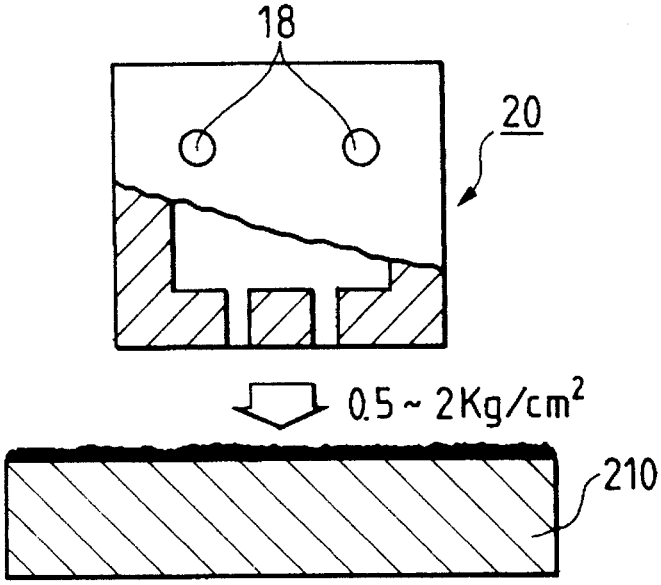
FIGS. 39A, 39B and 39C are schematic views explaining the surface treatment according to the present invention.
Figure 39B:
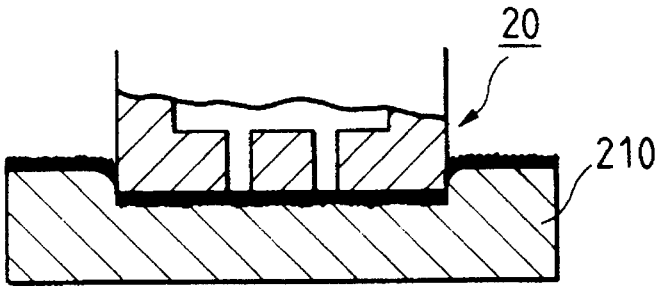
Figure 39C:
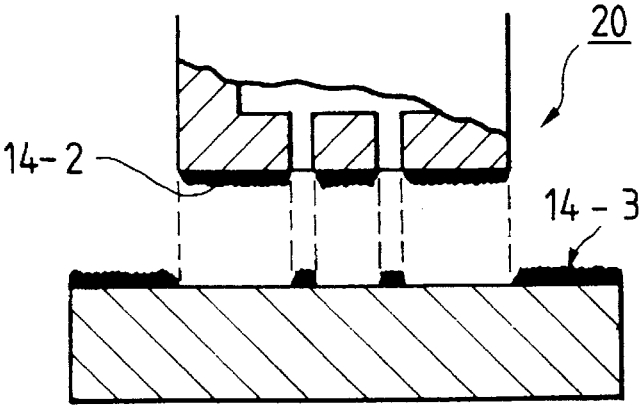

In this example, an ink jet recording head 20 with a structure as shown in FIGS. 1-C to 1-E was surface treated in the following manner. At first, a silicone rubber plate SH841U (trademark of a product made by Toray K.K., Japan) as an elastower formed by a mold with a predetermined surface roughness was prepared as a support. Then, the surface roughness r of the surface of the support was made 0.3 μm and the surface roughness R of the ink discharge surface of the ink jet recording head 20 was made 1 μm. Then, the support was dipped for at least 10 minutes in the same surface-treating agent as used in Example 13 to make swelling. Then, the support was pulled up and left standing in the atmosphere, whereby the swollen state was returned to the original state and an uniform thin layer of the surface-treating agent was formed on the irregular surface of the support 210 as shown in FIG. 39A. Then, the surface-treating agent was transferred onto the ink discharge surface of the ink jet recording head from the support 210 by a transfer process shown in FIGS. 39A to 39C, whereby the surface-treating agent was securely transferred only onto the peripheral parts of the discharge openings without entering of the surface-treating agent into the discharge openings to attain a water-repelling treatment of the ink discharge surface.

EXAMPLE 23

In this example, an ink jet recording head with a structure as shown in FIGS. 1A and 1B was surface treated in the following manner.

At first, an elastic silicone rubber plate as a tramsferring plate, for example SH841U, (trademark of a product by Shinetsu Kagaku Kogyo K.K., Japan) formed in a mold with a predetermined surface roughness was prepared. The irregularity pitch C on the support surface was set to about 25 μm, which was approximately one-half of the opening diameter (100 μm) of the discharge opening 5 of the ink jet recording head and the surface roughness r (average difference in height between the bottom of the concane part and the top of the convex part) was set to 3 μm.

Then, the support was dipped in the same ink-repellent, surface-treating agent as used in Example 22 for at least 10 minutes to make swelling. Then, the support was pulled up and left standing in the atmosphere, whereby the swollen state was returned to the original state and a uniform thin layer of the surface-treating agent was formed on the support surface.

Figure 40A:
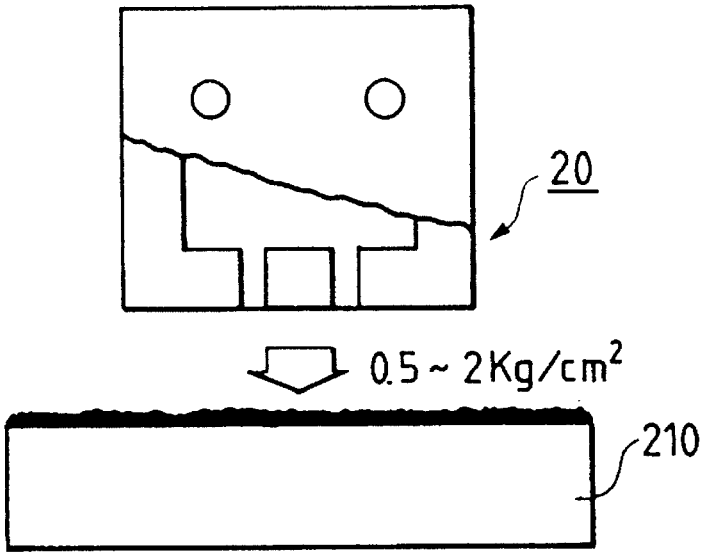
FIGS. 40A, 40B and 40C are schematic views explaining the surface treatment according to the present invention.
Figure 40B:
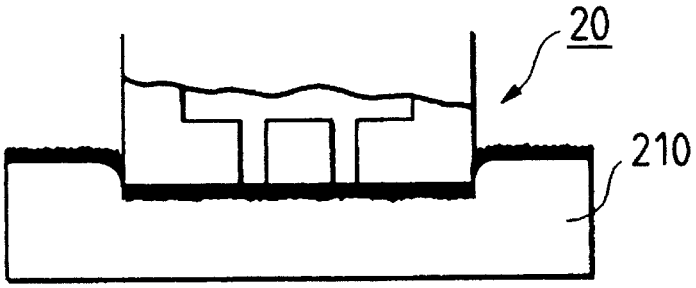
Figure 40C:
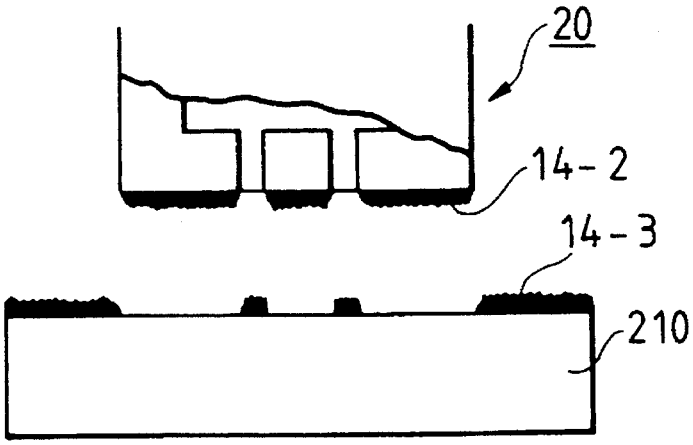

Then, the surface-treating agent was transferred onto the ink discharge surface of the ink jet recording head by pressing the ink discharge surface of the ink jet recording head 1 on the support surface through a transfer process as shown in FIGS. 40A, 40B and 40C, which will be described later, whereby the surface treatment could be securety carried out only on the pheirpheral parts of the discharge opening without entering of the surface-treating agent into the discharge opening.

The present surface treatment can be also applied to an ink jet recording head whose ink discharge surface is made of at least two different materials as shown in FIGS. 1-C to 1-E under the same conditions as in this Example 23. That is, formation of a thin layer of the surface-treating agent on the surface of support 210 can be carried out in the same manner as above and the transfer of the thin layer of the surface-treating agent can be carried out through the same transfer process as shown in FIGS. 40A, 40B and 40C.

In this Example 23, the surface of the elastomer as a support had not only a surface roughness r of 3 μm,but also an irregularity pitch C of not more than one half of the opening diameter of the discharge opening, and thus uniform surface treatment could be carried out only on the peripheral parts of the discharge opening without entering of the surface-treating agent into the discharge opening.

EXAMPLE 24

In this example, an ink jet recording head with a structure as shown in FIGS. 1C to 1E was used. That is, an ink jet recording head with an ink discharge surface which was surface finished to a pear-like surface having a surface roughness R of 5 μm by cutting with a diamond blade and grinding of the cut surface with an abrasive having a grain size of 8 μm was used. In order to transfer a surface-treating agent to the ink discharge surface of the ink jet recording head thus prepared, a swellable support having a surface roughness r of 0.5 μm and an irregularity pich C of not more than one half the opening diameter of the discharge opening was used and a thin layer of the surface-treating agent was formed on the support surface in the same manner as in Example 23. The surface-treating agent was transferred onto the ink discharge surface of the ink jet recording head through a transfer process as show in FIGS. 40A, 40B and 40C.

The surface-treating agent was securely retained in the fine concave parts on the pear like, roughed ink discharge surface and prevented from peeling off from the ink discharge surface even against wiping with a rubber blade in an ink jet recording apparatus.

EXAMPLE 25

In this example, the surface of a photosensitive unsaturated polyester elastomer (for example, APR, trademark of a product made by Asahi Kasei Kogyo K.K., Japan) as a support was made finely porous by a conventional photolithography, where the average pore diameter was one fourth of the opening diameter of the discharge opening.

Furthermore, irregularity was formed on the surface of the porous support to make a distance C between the centers of the two adjacent round indents about one-half of the opening diameter of the ink-discharge opening. Then, the suport was provided with a glass plage at the back side and an ink repellent, surface-treating agent was uniformly applied to the surface on the porous support, for example, by a spray.

Then, the surface-treating agent in excess was scraped off foom the surface of the support by travelling a metallic squeezee or knife along and in con/act with the surface of the support. It seems that most of the surface-treating agent existed in the concave parts of the support and a porton thereof remains at other parts than the concave parts.

Then, the ink discharge surface of the ink jet recording head was lightly pressed on the surface of the support from the overhead in the same manner as in Examples 16 and 18 to transfer the surface-treating agent onto the ink discharge surface of the ink jet recording head. After the transfer, the surface-treating agent was cured through reaction in the same manner as in Examples 16 and 18.

Thus, the entering of the surface-treating agent into the discharge opening can be more completely prevented by making the irregularity pitch on the surface of a porous support not more than one-half of the opening diameter of the discharge opening, and uniform surface treatment can be continuously carried out through pores having a pore size of not more than one-fourth of the opening diameter of the discharge opening.

In this example the photosensitive unsaturated polyester resin was used as a support, but the present invention is not limited thereto, any photosensitive material, such as photosensitive polyamide or photosensitive rubber, can be also used. In addition, ordinary resin materials having no photosensitivity can be also used by making a desired surface roughness through a mechanical processing or by forming it into a support in a mold with a desired surface roughness. The irregularity shape on the support surface is not limited to round indents shown in Examples 16 to 25, but other shapes, such as wave shapes, etc. can be used in the present invention.

The ink jet recording head with the surface-treated ink discharge surface is not limited to a single glass nozzle or a head with two discharge openings, but even the ink discharge surface of a multi-nozzle head with a few hundred to a few thousand nozzles can be likewise surface-treated according to the present invention. Thus, the present invention has a broad range of applications.

According to a sixth embodiment of the present invention the surface-treating agent layer is prevented from wearing or peeling by wiping with a rubber blade or the ink repellency of the surface-treating agent layer is prevented from deterioration.

That is, the present inventors have found that the surface-treating agent layer is not formed on the entire ink discharge surface of an ink jet recording head, but the ink discharge surface is partially surface-treated in a specific area ratio, whereby the durability of the surface-treating agent layer can be prolonged and a good ink repellency can be stably obtained.

EXAMPLE 26

In this example, an ink jet recording head with a form as shown in FIGS. 1C to 1E was prepared in the following manner.

At first, electro thermal conversion devices 11 were provided as discharge energy generating means on a first substrate 10 of silicone and conductor wirings (not shown in the drawings) were connected to both ends of each of the electro thermal conversion devices 11 to transmit an ink discharge signal thereto. A film of photosensitive resin was laid on the first substrate 10 by lamination and then discharge openings 14, liquid paths 13 and a liquid chamber 15 were formed by a photolithography of the film. Furthermore, a second substrate 16 of glass provided with an ink supply hole 18 was laid on and bounded to the partition wall of the cured film of photosensitive resin through an adhesive layer 17. Then, the resulting laminate was cut to form an ink discharge surface 14-1. An ink jet recording head in the form shown in FIGS. 1C to 1E was prepared thereby.

Then, the thus prepared ink jet recording head was surface treated in the following manner.

Figure 41A:
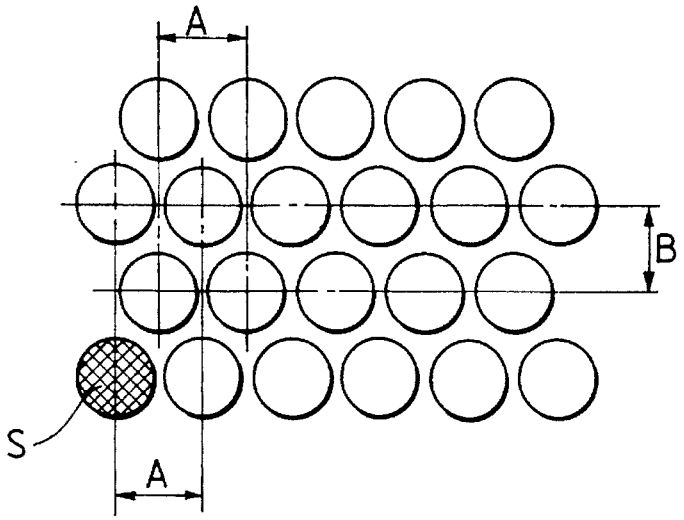
FIGS. 41A and 41B are schematic views explaining a support for use in the surface treatment according to the present invention.
Figure 41B:
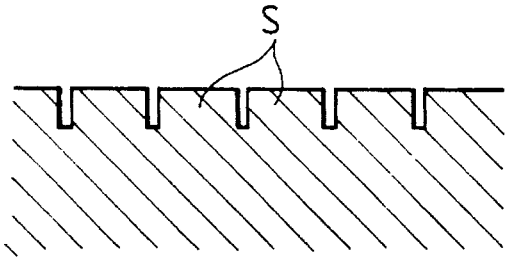

At first, a photosensitive unsaturated polyester resin, for example, APR (trademark of a product made by Asahi Kasei Kogyo K.K. Japan). was processed into a shape as shown in FIGS. 41A and 41B as a support by a conventional potography. That is, round comvex parts S were provided on the support surface as shown in FIGS. 41A and 41B, where distances A and B between the centers of two adjacent convex parts in the lateral direction and the longitudinal direction, respectively, were made one-fourth of one side of a square having the same area as the discharge opening area and the surface area of one convex part S was made 60% of the predetermined area A×B.

Figure 42:
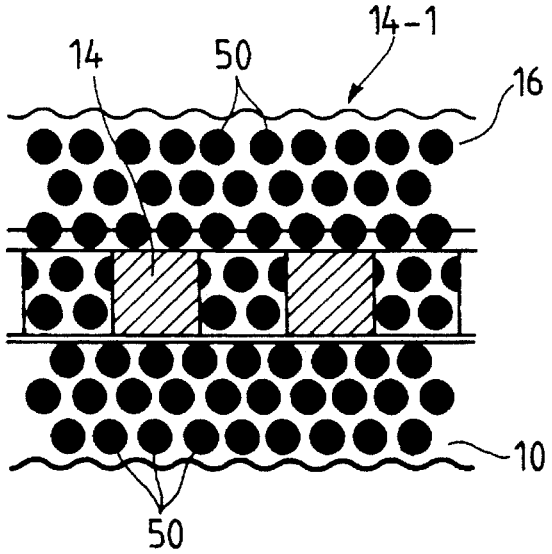
FIG. 42 is a schematic front view showing an ink jet recording head as surface-treated according to the present invention.

A Daiflon S3 solution containing 0.01 wt. % of fluoro silicon KP 801 (trademark of a product made by Shinetsu Kogaku Kogyo K.K. Japan) was uniformly sprayed as a surface treating agent onto the support surface by a spray and dried for 5 minutes. Then, the ink discharge surface of the ink jet recording head was pressed on the support surface under a pressure of about 2 kg/cm$^2$ for a few seconds to transfer the surface treating agent onto the ink discharge surface of the ink jet recording head through the convex parts of the support. Then, the ink jet recording head was dried at 150° C. for two hours (sample Likewise, supports having convex parts S whose one convex part area was made 70% of the predetermined area A×B (sample 21), 80% of A×B (sample 22) and 90% of A×B (sample 23), that is, by an area increase of 10% of the predetermined area A×B for each, and the same surface treating agent layer was formed on the convex parts of the supports and transferred onto the ink discharge surfaces of ink jet recording heads, whereby the ink jet recording heads with an insular surface treating layer, as shown in FIG. 42 were obtained. In FIG. 42, numeral 50 is insular depositions of the surface treating agent formed on the ink discharge surface 14-1 of an ink jet recording head by transfer, which has substantially the same shape as S on the supports.

Preparation of comparative sample 24:

A support with convex parts whose one convex part area S was made 50% of the predetermined area A×B was prepared and likewise the same surface treating agent as used above was transferred from the support onto the ink discharge surface of an ink jet recording head and dried at 150° C. For two hours.

Preparation of comparative sample 25

Pure water was filled in the liquid paths 13 as far as the discharge openings 14 of the ink jet recording head, and then the ink discharge surface of the ink jet recording head was dipped in the solution of the same treating agent KP 801 for 2 to 3 seconds. Then, the filled pure water was withdrawn from the ink Jet recording head, and the head was dried at 150° C. for 2 hours. That is, the surface treating agent was laid on the entire ink discharge surface after the drying.

Figure 43A:
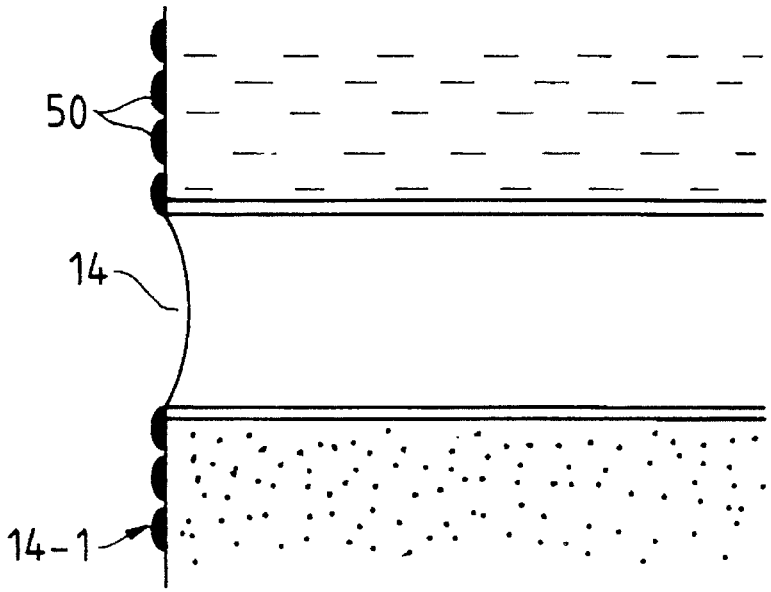
FIGS. 43A and 43B are schematic views showing the surface treatment according to the present invention.
Figure 43B:
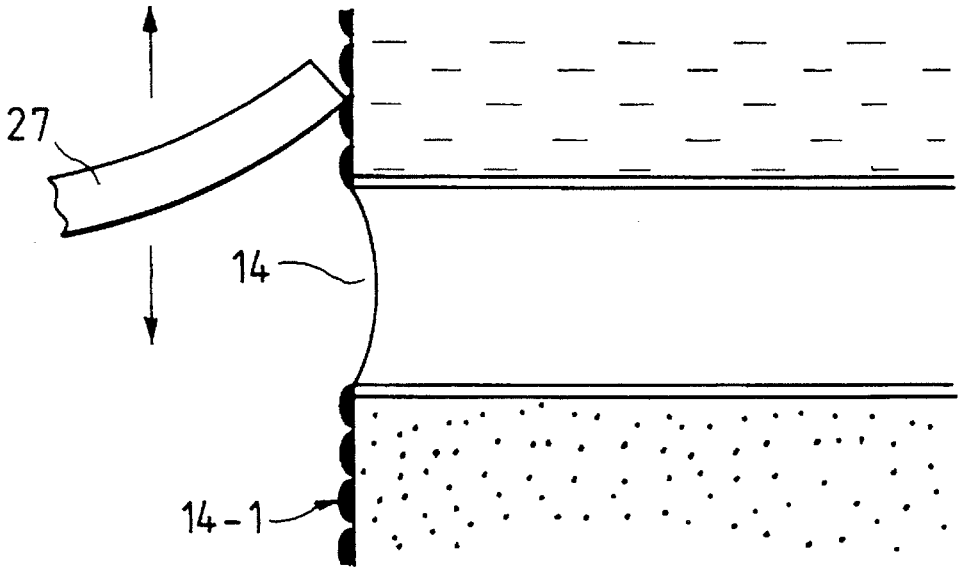

In order to test the durability of the surface treated ink discharge surfaces of samples 20 to 23 according to this Example 26 and comparative samples 24 and 25, the ink discharge surfaces 14-1 with the surface treating agent deposits 50 were wiped with a rubber blade 27, as shown in FIG. 43B, and the state of printed letters was examined after several thousand wipings. The results are shown in the following Table 6.

TABLE 6

| | Sample | | | | | |
|---|---|---|---|---|---|---|
| | ⑳ | ㉑ | ㉒ | ㉓ | ㉔ | ㉕ |
| Ratio of surface-treated area to the predetermined area (%) | 60 | 70 | 80 | 90 | 50 | 100 |
| Number of wiping | | | | | | |
| Initial | ○ | ○ | ⊙ | ⊙ | X | ⊙ |
| 1,000 wipings | ○ | ○ | ⊙ | ⊙ | X | ○ |
| 5,000 wipings | ○ | ⊙* | ⊙ | ⊙ | X | X |
| 10,000 wipings | ○ | ○ | ○ | ○ | X | X |
| 15,000 wipings | Δ | ○ | ○ | ○ | X | X |

Remarks ⊙: Best; ○: good; X: poor; Δ: a little poor
*: Sample ㉑ was not so deteriorated as other samples upon comparison of 1,000-wiping results with 5,000-wiping results and thus marked with "⊙*".

That is, such an unexpected effect was found in Example 26 that, when a ratio of the surface treated area to the Predetermined area A×B of the ink discharge surface was 60% or more, the state of printed letters was kept almost equal, even after 10,000 wipings, to that at the initial stage and had no practical trouble. It was also found that in case of sample 25 the surface treating layer was peeled off at the edge parts of the discharge openings 14 or slipped into the discharge openings with increasing number of wiping, resulting in deterioration of the quality of printed letters to a level of poor printing.

Figure 44A:
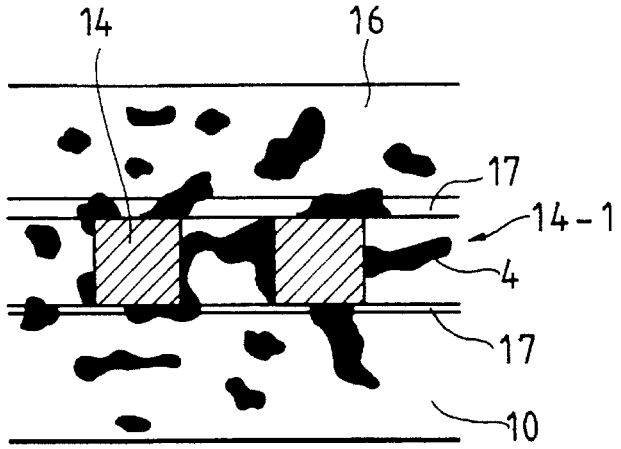
FIGS. 44A, 44B and 44C are schematic views explaining the surface treatment according to the present invention and the prior art.
Figure 44B:
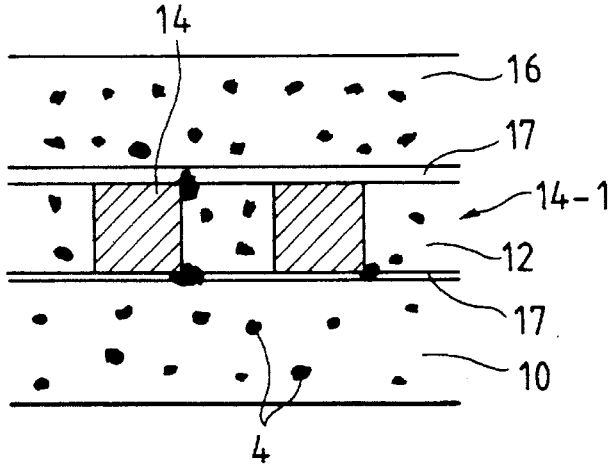
Figure 44C:
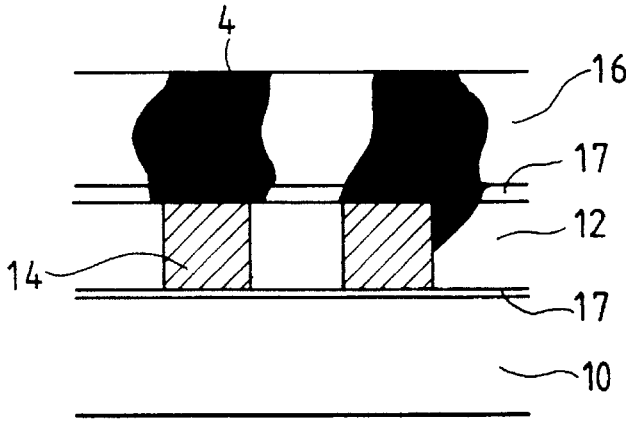

FIGS. 44A to 44C show the states of ink deposition on the ink discharge surface after 10,000 wipings. In case of sample 20 some deposition of ink 4 was observed at the peripheral parts of the discharge openings 14 on the ink discharge surface as shown in FIG. 44A, where the deposition had no adverse effect on the ink discharge, whereas in case of sample 22 having a ratio of the treated surface area of 80%, no substantial ink deposition, that is, a good surface state, was observed, as shown in FIG. 44B. In case of sample 25, on the other hand, the ink 4 was deposited in a wide area particularly from the second substrate 16 to the peripheral parts of the discharge openings 14 due to the peeling off of the surface treating layer, as shown in FIG. 44C.

EXAMPLE 27

In this example, an ink jet recording head with an ink discharge surface of uniform, pear like irregularity having an surface roughness R (average difference in height between the top of convex part and the bottom of concave part) of 3 μm, and a surface treating layer was formed on the ink discharge surface in the following manner.

Figure 45A:
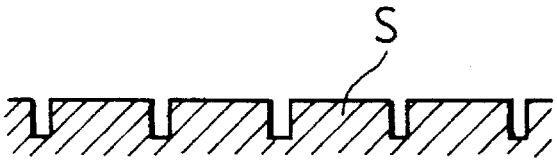
FIGS. 45A and 45B are schematic views explaining a support for use in the surface treatment according to the present invention.
Figure 45B:
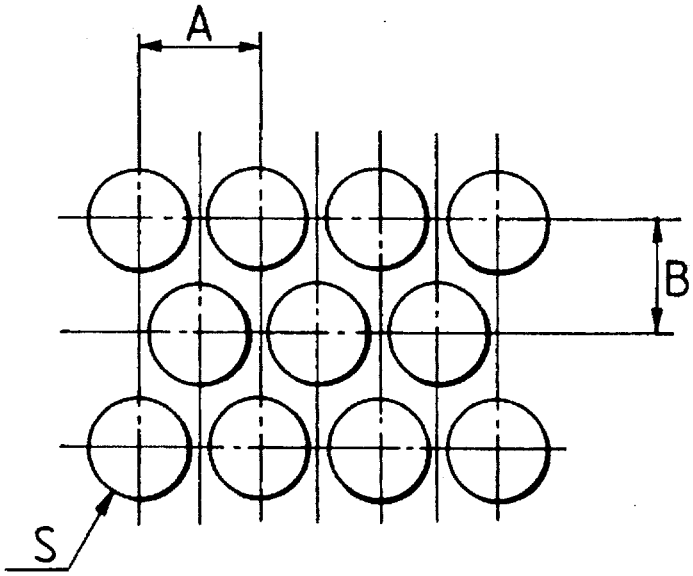

At first, a photosensitive unsaturated polyester elastomer, for example, APR (trademark of a product made by Asahi Kasei Kogyo K.K., Japan) as a support was processed into a shape shown in FIGS. 45A and 45B by a conventional photography. That is, round convex parts S were provided on the support surface, as shown in FIGS. 45A and 45B and the distances A and B between the centers of adjacent two round convex parts in the lateral direction and the longitudinal direction were made one fourth of one side of the discharge opening 14 and a ratio of surface area S of one convex part to the predetermined area A×B was made 60%.

Figure 46:
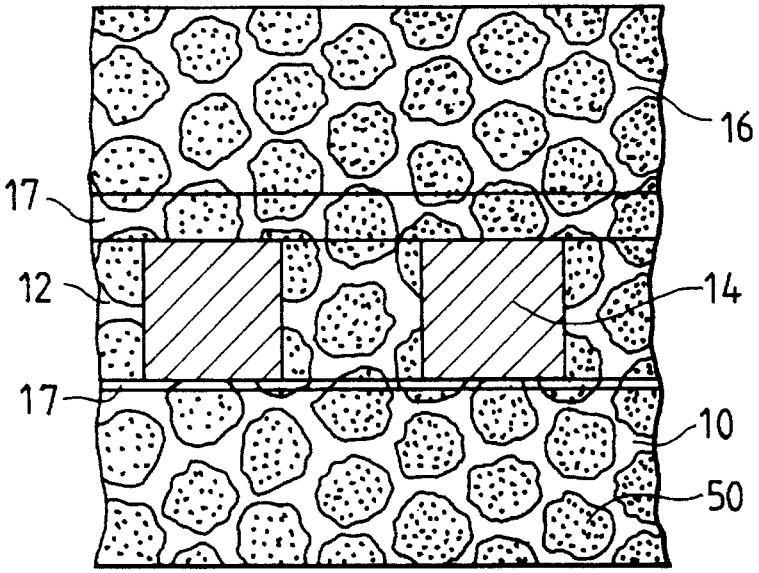
FIG. 46 as a schematic view explaining the surface treatment according to the present invention.

A Daiflon S3 solution containing 0.01 wt. % of fluoro silicon KP 801 (trademark of a product made by Shinetsu Kogaku Kogyo K.K., Japan) as a surface treating agent was uniformly sprayed onto the support surface by a spray and dried for 5 minutes. Then, the ink discharge surface of the ink jet recording head was pressed on the support surface under a pressure of about 2 kg/cm$^2$ for a few seconds to transfer the surface treating agent onto the ink discharge surface of the ink jet recording head through the convex parts on the support surface. Then, the head was dried at 150° C. for 2 hours to obtain an ink jet recording head with the ink discharge surface shown in FIG. 46 (sample 26).

Supports with surfaces having convex parts in ratios of convex part surface area S to the predetermined area A×B of 70%, 80% and 90%, respectively, were prepared, and the same surface treating layer as above was formed on the support surfaces and then transferred onto the ink discharge surfaces 14-1 of the ink jet recording head and dried at 150° C. for 2 hours to obtain samples 27, 28 and 29.

Figure 47:
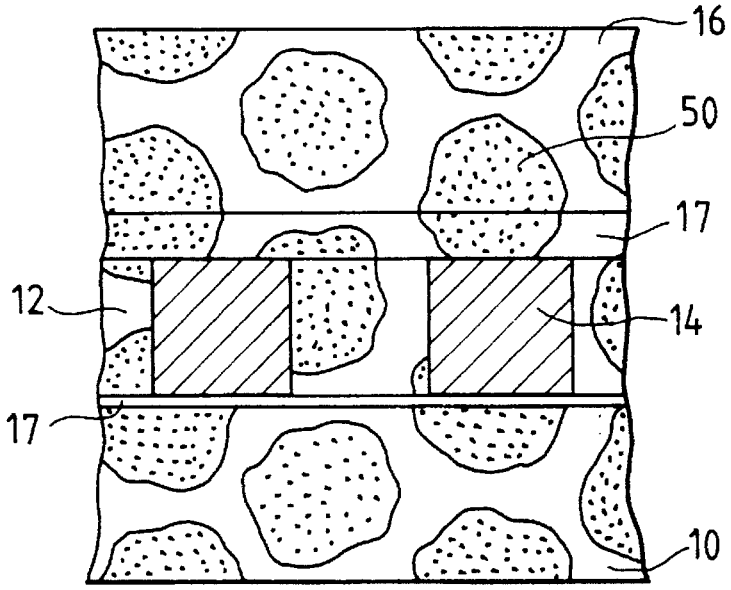
FIG. 47 is a schematic view explaining the surface treatment according to a comparative example.

Preparation of comparative sample 30:

Likewise, a support with a surface having convex parts in a ratio of convex part surface area S to the predetermined area A×B of 50% was prepared and the same surface treating agent as above formed on the support surface and then transferred onto the ink discharge surface 14-1 of the ink jet recording head, dried at 150° C. for 2 hours to obtain the ink jet recording head with the ink discharge surface shown in FIG. 47 as sample 30.

In order to test the durability of the treated ink discharge surfaces of samples 26 to 29 and comparative sample 30, the ink discharge surfaces 14-1 with the surface treating agent layer were wiped with a rubber blade 15 as shown in FIG. 43B, and the state of printed letters was examined after wipings. The results are shown in the following Table 7.

TABLE 7

| | Sample | | | | |
|---|---|---|---|---|---|
| | ㉖ | ㉗ | ㉘ | ㉙ | ㉚ |
| Surface finishing | cutting grinding stone #600, grain size: 30 μm | | | | |
| Average surface roughness R | 3 μm | | | | |
| Ratio of treated surface area to the predetermined area (%) | 60 | 70 | 80 | 90 | 50 |
| Number of wiping | | | | | |
| Initial | ○ | ○ | ⊙ | ⊙ | X |
| 100 wipings | ○ | ○ | ⊙ | ⊙ | X |
| 1,000 wipings | ○ | ⊙* | ⊙ | ⊙ | X |
| 10,000 wipings | ○ | ○ | ○ | ○ | X |
| 15,000 wipings | ○ | ○ | ○ | ○ | X |

Remarks *: Sample ㉗ was not so deteriorated as other samples upon comparison of 1,000-wiping results with 5,000-wiping results and thus marked with "⊙*".

EXAMPLE 28

In this example the same ink jet recording head as in Example 27 was surface treated in the following manner.

Figure 48A:
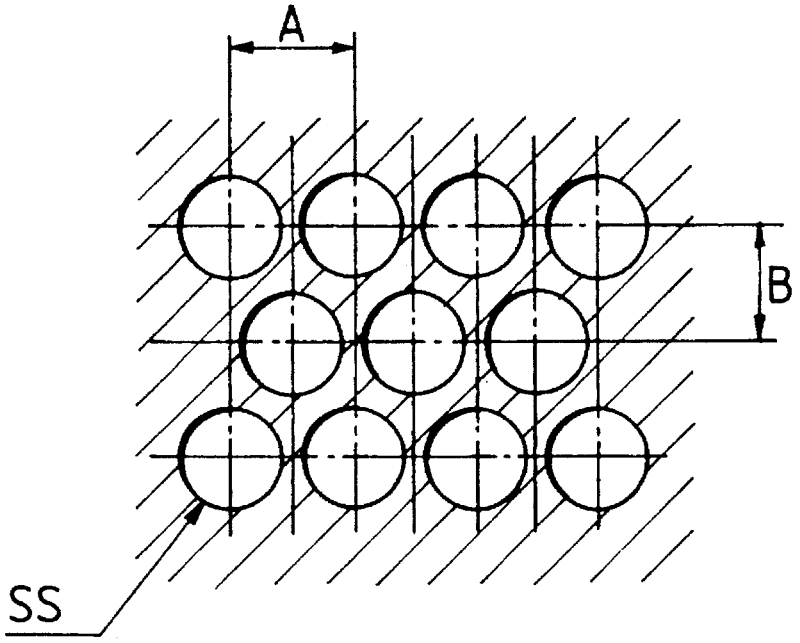
FIGS. 48A and 48B are schematic views explaining a support for use in the surface treatment according to the present invention.
Figure 48B:
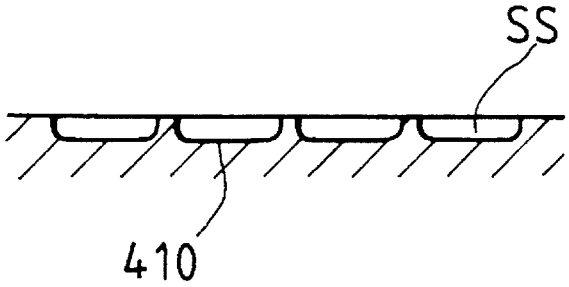

A photosensitive unsaturated polyester elastomer APR (trademark of a product made by Asahi Kasei Kogyo K.K., Japan) as a support was processed into a shape shown in FIGS. 48A and 48B by a conventional photolithography.

That is, round concave parts SS were provided on the surface of the support 410, and distances A and B between the centers of two adjacent concave parts in the lateral direction and the longitudinal direction, respectively, were made one fourth of one side of one square discharge opening 14 and area of one concave part SS was made 60% of the predetermined area A×B.

A Daiflon S3 solution containing 0.01 wt. % of fluorosilicon KP 801 (trademark of a product made by Shinetsu Kagaku Kogyo K.K., Japan) was uniformly sprayed as a surface treating agent onto the surface of the support 410 by a spray and a metallic squeeze or knife was moved along and in contact with the support surface to wipe the surface treating agent in excess away from the support surface. It seems that most of the surface treating agent existed in the concave parts SS of the support 410, whereas a very small portion thereof remained on the convex parts.

Figure 49:
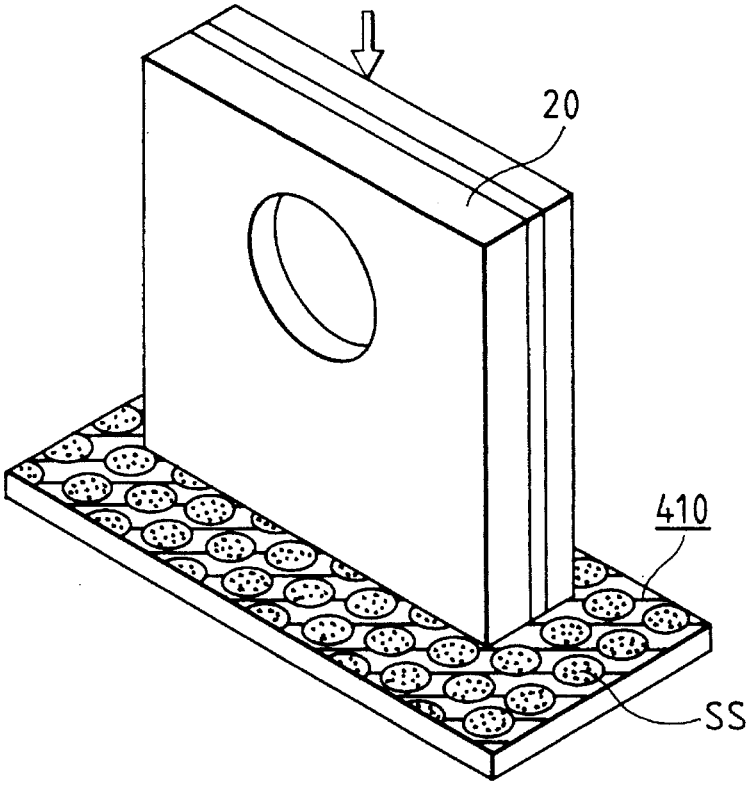
FIGS. 49 and 50 are schematic views explaining a support for use in the surface treatment according to the present invention.

Then, the ink discharge surface 14-1 of the ink jet recording head 20 was pressed on the thus prepared support surface under a pressure of about 2 kg/cm$^2$ for a few seconds as shown in FIG. 49, whereby mainly the surface treating agent existing in the concave parts SS of the support 410 was transferred onto the surface of the ink jet recording head. Then, the head 20 was dried at about 150° C. for 2 hours to strongly fix the surface treating agent layer to the ink discharge surface of the head 20 (sample 31).

Likewise, the same surface treating layer as above was formed on a support 410 with a surface having concave parts SS, where a ratio of one concave part area to the predetermined area A×B was made 90%, and transferred onto the ink discharge surface 14-1 of the ink jet recording head and dried at 150° C. for 2 hours to obtain an ink jet recording head with substantially the same treated ink discharge surface as shown in FIG. 42 (sample 42). In FIG. 49, SS shows the concave parts in which the surface treating agent exists in an insular form.

Preparation of comparative sample 33:

Likewise, the same surface treating agent layer as above was formed on a support 410 with a surface having concave parts SS, where a ratio of one concave part area to the predetermined area A×B was made 50%, and transferred onto the ink discharge surface 14-1 of the ink jet recording head and dried at 150° C. for 2 hours to obtain an ink jet recording head (sample 33).

Durability test results made in the same manner as in Example 27 are shown in the following Table 8, from which it is clear that samples 31 and 32 had a good durability, whereas in case of the ink jet recording head of sample 33 the quality of printed letters was continuously deteriorated with increasing repetitions of wiping with the rubber blade, as compared with samples 31 and 32.

TABLE 8

| | Sample | | |
|---|---|---|---|
| | 31 | 32 | 33 |
| Ratio of treated surface area to the predetermined area (%) | 60 | 90 | 50 |
| Surface finishing | cutting grinding stone #600, grain size: 30 μm | | |
| Average surface roughness, R | 3 μm | | |
| Number of wipings | | | |
| Initial | ◎ | ◎ | X |
| 100 wipings | ◎ | ◎ | X |
| 1,000 wipings | ◎ | ◎ | X |
| 10,000 wipings | ◎ | ◎ | X |

EXAMPLE 29

In this example, an ink jet recording head 20 was surface treated in the following manner.

At first, a Daiflon S3 solution containing 0.01 wt. % of fluorosilicone based, ink repelling agent KP 801 (trademark of a product made by Shinetsu Kagaku Kogyo K.K., Japan) was uniformly sprayed as a surface treating agent on to the smooth surface of a support 410 and a metallic squeezee or knife was lightly moved along and in contact with the support surface to wipe the surface treating agent in excess away from the support surface whereby a uniform surface treating agent layer was formed on the support surface.

Figure 50:
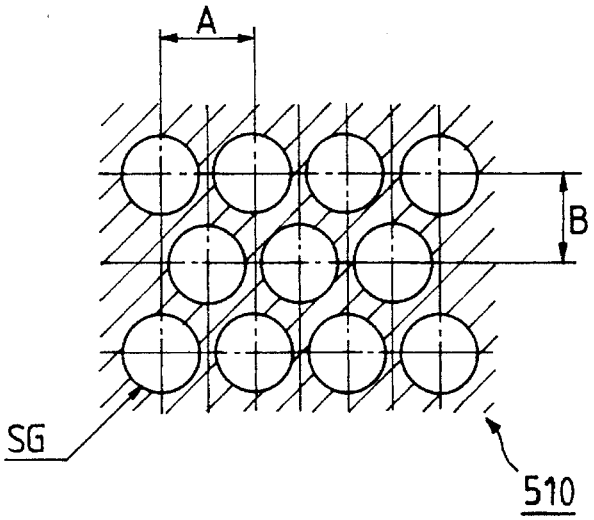
Figure 51:
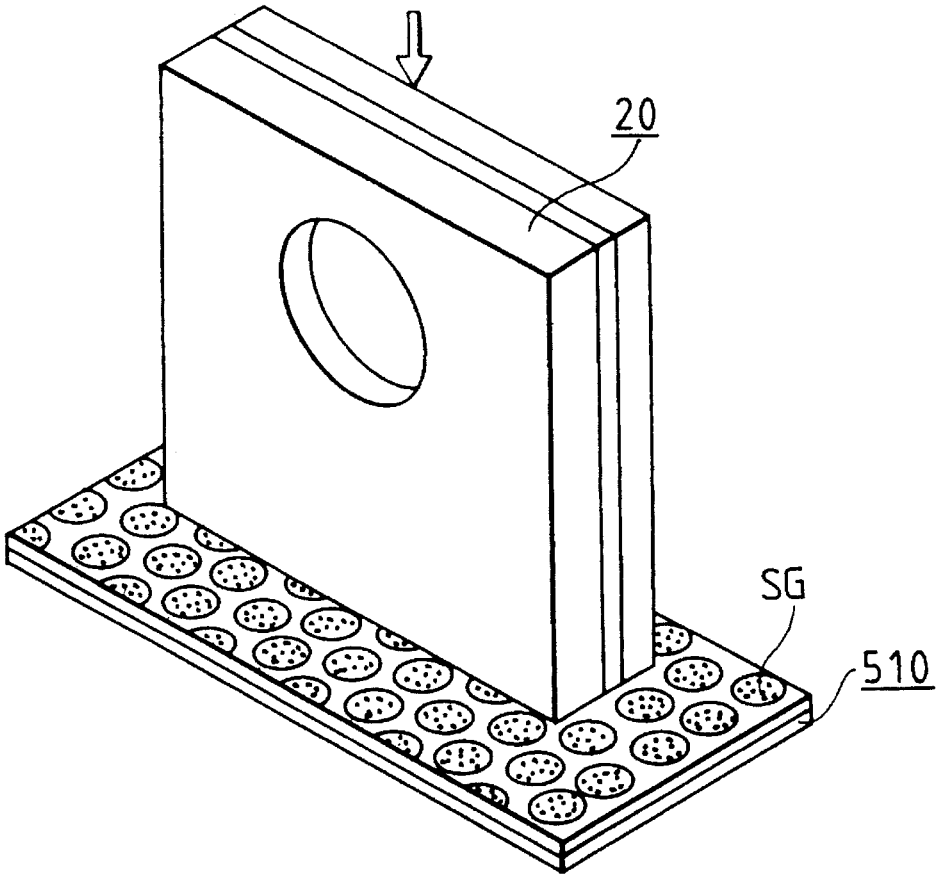
FIG. 51 is a schematic view explaining a support for use in the surface treatment according to the present invention.

On the other hand, a thin Ni plated screen 510 having a thickness of, for example, 2 μm to 5 μm was prepared by known photolithography and plating technique, as shown in FIG. 50. That is, round holes SG were provided on the screen 510, as shown in FIG. 50, where distances A and B between the centers of two adjacent round holes in the lateral direction and the longitudinal direction, respectively, were made one fourth of one side of one discharge opening 14 and the area of one round hole SG was made 60% of the predetermined area A×B. The screen 510 was placed on the surface of support 410, coated with the surface treating agent and then the ink discharge surface 14-1 of the ink jet recording head was pressed on the support head through the screen under a pressure of 2 kg/cm$^2$ for a few seconds from the overhead, as shown in FIG. 51, whereby the surface treating agent in a liquid state was transferred onto the ink discharge surface 14-1 from the support surface through the round holes SG of screen 510. Then, the head 20 was dried at about 150° C. for 2 hours, whereby the surface treating agent was strongly fixed to the ink discharge surface of the ink jet recording head 20. After the drying the peripheral parts of the discharge openings was inspected and it was found that the surface treating agent was almost uniformly distributed and deposited only on the ink discharge surface to form a surface treating agent layer, as shown, in FIG. 52 (sample 34).

Likewise, the same surface treating layer as above was formed on supports and transferred onto the ink discharge surfaces of the ink jet recording heads through screens with round holes SG in ratios of one round hole area to the predetermined area A×B were 70%, 80% and 90%, respectively, and dried at 150° C. for 2 hours, whereby ink jet recording heads with the substantially same treated ink discharge surfaces as in FIG. 42 were obtained (samples 35, 36 and 37).

Preparation of comparative sample 38:

Likewise, the same surface treating agent layer as above was formed on a support and transferred onto the ink discharge surface of the ink jet recording head through a screen with round holes SG in a ratio of one round hole area to the predetermined area A×B was 50% and dried at 150° C. for 2 hours, whereby an ink jet recording head was obtained (sample 38).

Figure 52:
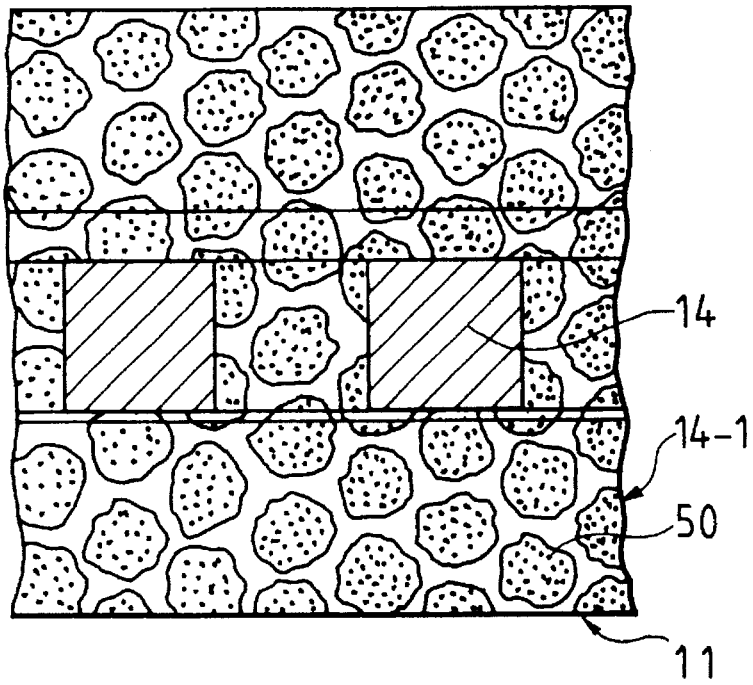
FIG. 52 is a schematic front view explaining the surface treatment according to the present invention.

In order to examine the durability of the surface treating agent layers on the ink discharge surfaces of the thus prepared ink jet recording heads, the ink discharge surfaces 14-1 with the deposits 50 of the surface treating agent layers as shown in FIG. 52 were wiped with a rubber blade, and the state of printed letters obtained after the wiping was observed. The results are shown in the following Table 9.

TABLE 9

| | Sample | | | | |
|---|---|---|---|---|---|
| | 34 | 35 | 36 | 37 | 38 |
| Ratio of treated surface to area to the predetermined area (%) | 60 | 70 | 80 | 90 | 50 |
| Number of wiping | | | | | |
| Initial | ○ | ○ | ◎ | ◎ | X |
| 1,000 wipings | ○ | ○ | ◎ | ◎ | X |
| 5,000 wipings | ○ | ◎* | ◎ | ◎ | X |
| 10,000 wipings | ○ | ○ | ○ | ○ | X |

Remarks *: Sample 35 was not so deteriorated as other samples upon comparison of 1,000-wiping results with 5,000-wiping results and thus marked with "◎*".

That is, it is confirmed from the results shown in Table 9 that in case of samples 34 to 37, where a ratio of the surface treated area at the peripheral parts of the discharge openings to the predetermined area A×B was 60% or more, the state of printed letters was kept almost equal, even after 10,000 wipings, to that at the initial stage and had no practical troubles. It was also found that in case of sample 38 the surface treating layer was peeled off at edge parts of the discharge openings or slipped into the discharge openings with increasing number of wiping, resulting in deterioration of the quality of printed letters to a level of poor printing.

In the foregoing Examples 26 to 29, an elastomer was used as a support, but a swellable material capable of swelling with a surface treating agent or a porous material having a predetermined pore size as explained in the preceding Examples could be used to conduct a continuous surface treatment. In these cases, ink jet recording heads with a more uniform surface treating layer could be continuously prepared on a mass production scale.

EXAMPLE 30

In this example, diamond cutting grinding stones having diamond grain sizes ranging from 10 μm to 30 μm were used to give different surface roughnesses to the ink discharge surfaces of ink jet recording heads. That is, the ink discharge surfaces were processed to be provided into uniform, pear like irregularities having an average surface roughness R of 10.5 μm to 3 μm.

Figure 53:
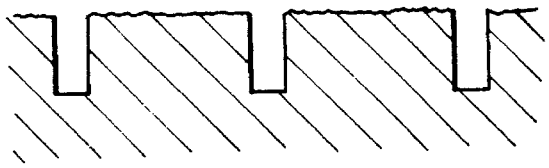
FIG. 53 is a schematic view of a support which explains the surface treatment according to the present invention.

Then, a support was prepared in the following manner:

A photosensitive unsaturated polyester resin plate as a transfer support specifically APR (tradename of a product made by Asahi Kasei K.K.), was processed into a shape as shown in FIGS. 41A and 41B by a well known photolithography. Detail of the processing is omitted from further description, because the processing was the same as used before. Then, an oxygen plasma ($O_2$: 1 mm Hg, RF 50W for 5 minutes) was applied to the thus cured support to form a somewhat fine irregularity to the support surface. Upon measurement of the surface roughness, it was found that the support surface had a surface roughness r of about 0.1 μm and an irregularity pitch of not more than one half of the opening size of the discharge opening, as shown in FIG. 53.

Figure 54:
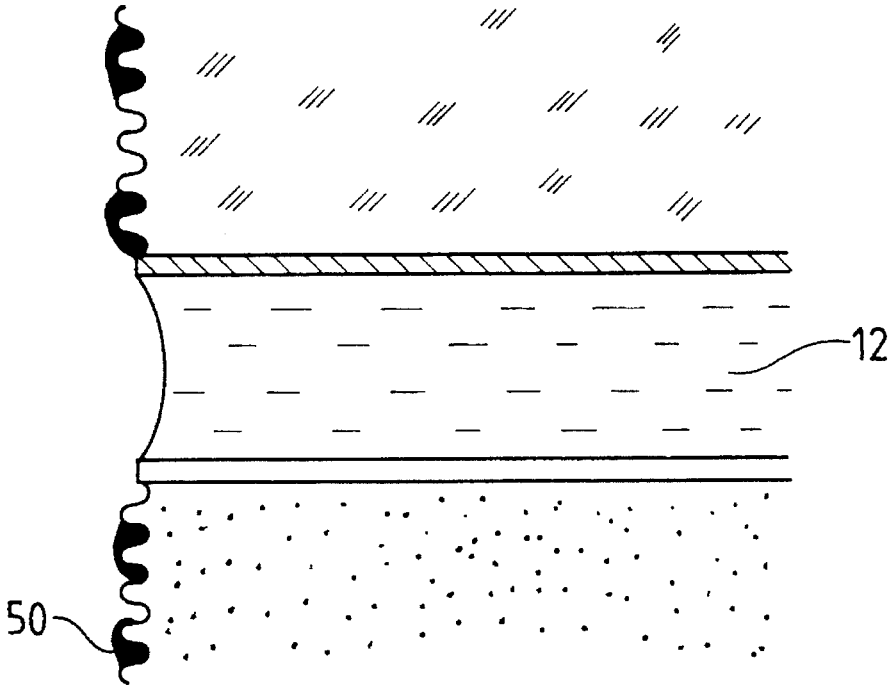
FIG. 54 is a schematic front view explaining the surface treatment according to the present invention.

A Daiflon S3 solution containing 0.01% by weight of fluorosilicone water-repelling agent KP 801 (trademark of a product made by Shinetsu Kagaku Kogyo K.K., Japan) as a surface treating agent was uniformly sprayed onto the support surface by a spray and dried for 5 minutes. Then, the ink discharge surface of the ink jet recording head was pressed on the support surface under a pressure of about 2 kg/cm$^2$ for a few seconds from the overhead to transfer the surface treating agent onto the ink discharge surface of the ink jet recording head through the convex parts S. Then, the head was dried at 150° C. for 2 hours. As a result, an ink jet recording head with the deposition of the surface treating agent on the ink discharge surface as shown in FIG. 54 was obtained. Numeral 50 is the surface treating agent transferred and deposited in an insular form on the ink discharge surface of the ink jet recording head.

In this Example 30, at least the peripheral parts of the discharge openings on the ink discharge surface on which the discharge openings are provided is made into a pear like surface of fine surface irregularity and the surface treating agent is partially deposited onto the pear like ink discharge surface, as described above, whereby the deposited surface treating agent can be prevented from peeling off by wiping with a rubber blade and ink discharge can be stable carried out for a long time. Thus, an ink jet recording head capable of recording with a high quality of printed letter can be provided according to the present invention. Furthermore, a pear like surface of a desired surface irregularity can be more simply formed on the ink discharge surface than the mirror finished surface, and thus the ink discharge surface of an ink jet recording head can be much readily surface treated at a low cost. Still furthermore, the irregularity pitch on the surface of a support for use in the transfer of a surface treating agent can be made not more than one half of the opening size of a discharge opening, and thus the support can be much simply prepared. As a further effect of the present invention, a surface area occupied by a surface treating agent is 60% or more of the area of the entire region to be surface treated, and thus the ink discharge surface can be very simply and effectively surface treated with a broad allowance for the manufacturing control.

In this Example 30, the durability of the surface treating layer was more improved than in other Examples of the present invention.

EXAMPLE 31

In this example, the same ink jet recording head as in the foregoing examples was surface treated in the following manner.

The surface treating agent KP 801 was dispersed in ethanol as a dispersing medium to prepare a dispersion consisting of 1 wt. % of KP 801 and 99 wt. % of ethanol.

A silicone rubber plate having a thickness of 0.5 mm was used as a support and spin coated with the dispersion just after good stirring to form a surface treating agent layer in insular form dots at random on the silicon rubber plates. The surface treating layer was then transferred onto the ink discharge surfaces of an ink jet recording heads from the support to make a surface treatment in the same ratios of treated surface area to the predetermined area of 60, 70, 80 and 90% as in the foregoing examples.

In the foregoing Examples 24 to 28, the surface treating agent layer on the support surface, which corresponded to the region to be surface treated on the ink discharge surface, were in a round form or similar form as most preferable embodiments, but with the surface treating agent layer in irregular forms as in this Example, or in irregular or regular polygonal forms, the desired effect of surface treatment could be also obtained.

According to Examples 26 to 31, the surface treating layer is substantially uniformly distributed and formed at least at the peripheral parts of the discharge openings and the area of deposited portion are made 60% to 90% of the area of peripheral part, as described above, whereby the surface treating layer can be prevented from peeling off by wiping with a rubber blade and an ink jet recording head capable of stably discharging an ink for a long time and carrying out recording with a high quality can be provided. Furthermore, ink jet recording heads can be prepared in a very simple process.

In the foregoing examples the present invention has been fully described. The ink jet recording heads to which the present invention is applicable are all the ink jet recording heads including the so called shooter type that discharges an ink in crossed directions with respect to the heat generating surface of an electro thermal conversion device, a full line type, long head, a disposable type integrated with an ink tank, a type of utilizing an additional air stream, etc. besides the types specifically explained in the foregoing examples. Thus, the shape of the ink discharge surface is not limited to the plane, but may include a curved surface.

Shapes, materials, etc. of the ink discharge surface, support, surface treating agent, etc. used in the foregoing examples can also provide better effects upon appropriate selection of combinations other than those disclosed in the forgoing examples.

We claim:

1. An ink jet recording head for discharging a liquid droplet to effect printing on a printing medium, comprising:

a discharge opening surface on which a discharge opening for discharging the liquid droplet is provided;

a liquid path communicating with said discharge opening to supply the liquid to said discharge opening; and an energy generating means for generating a discharge energy to be utilized for discharging the liquid droplet, wherein the discharge opening surface has been partially subjected to a liquid repellant treatment in a pattern consisting of a plurality of pattern elements each having a center, and a surface area of a given said pattern element being at least about 60% of an area A×B, wherein A is a lateral distance between said centers of adjacent said pattern elements in a lateral direction and B is a longitudinal distance between said centers in a longitudinal direction.

2. An ink jet recording head according to claim 1, wherein the pattern elements have protruding portions each having a top and a bottom of a recessed portion and said pattern elements have a surface roughness R which corresponds to an average difference in height between the top of the protruding portion and the bottom of the recessed portion, said surface roughness being between 0.5 μm and 10 μm.

3. An ink jet recording head according to claim 1, wherein a surface roughness R of said pattern elements is approximately 3 μm.

4. An ink jet recording head according to claim 1, wherein said pattern elements are round.

5. An ink jet recording head according to claim 1, wherein said lateral distance A and said longitudinal distance B are each approximately ¼ of a length of a side of a square which has an area that is about that of an area of the discharge opening.

6. An ink jet recording head according to claim 1, wherein a surface area of a given said pattern element is at least about 70% of said area A×B.

7. An ink jet recording head according to claim 1, wherein a surface area of a given said pattern element is at least about 80% of said area A×B.

8. An ink jet recording head according to claim 1, wherein a surface area of a given said pattern element is at least about 90% of said area A×B.

9. An ink jet recording head for discharging a liquid droplet to effect printing on a printing medium, comprising:

a discharge opening surface on which a discharge opening for discharging the liquid droplet is provided, the discharge opening surface having a liquid repellant region around the discharge opening, and having an area;

a liquid path communicating with the discharge opening to supply the liquid to the discharge opening; and an energy generating means for generating an energy to be utilized for discharging the liquid droplet, wherein the liquid repellant region has been subjected to a patterning treatment to form a patterned liquid repellant portion having an area, and wherein the area of the patterned liquid repellant portion of the liquid repellant region is between 60% and 100% of the area of the liquid repellant region.

* * * * *

UNITED STATES PATENT AND TRADEMARK OFFICE

CERTIFICATE OF CORRECTION

PATENT NO. : 5,581,285

DATED : December 3, 1996

INVENTOR(S) : TAKASHI WATANABE ET AL.

It is certified that error appears in the above-identified patent and that said Letters Patent is hereby corrected as shown below:

ON THE TITLE PAGE:

[56] REFERENCES CITED

Foreign Patent Documents, "0268213 5/1988 European Pat. Off.." should be deleted.

COLUMN 1

Line 29, "Rapers" should read --papers--.
Line 40, "electro-thermo" should read --electro-thermal--.

COLUMN 2

Line 23, "discharge" should read --the discharge--.
Line 32, "so called" should read --so-called--.

COLUMN 4

Line 9, "is" should read --in--.
Line 27, "producing." should read --producing--.
Line 48, "recording-based" should read --recording based--.

COLUMN 6

Line 6, "B" should read --18B--.

UNITED STATES PATENT AND TRADEMARK OFFICE

CERTIFICATE OF CORRECTION

PATENT NO. : 5,581,285

DATED : December 3, 1996

INVENTOR(S) : TAKASHI WATANABE ET AL.

It is certified that error appears in the above-identified patent and that said Letters Patent is hereby corrected as shown below:

COLUMN 8

Figure 2A:
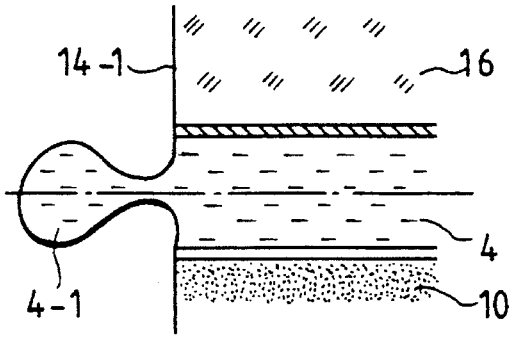
FIG. 2A PRIOR ART
FIGS. 2A and 2B are schematic views explaining the state of ink discharge by an ink jet recording head.
Figure 2B:
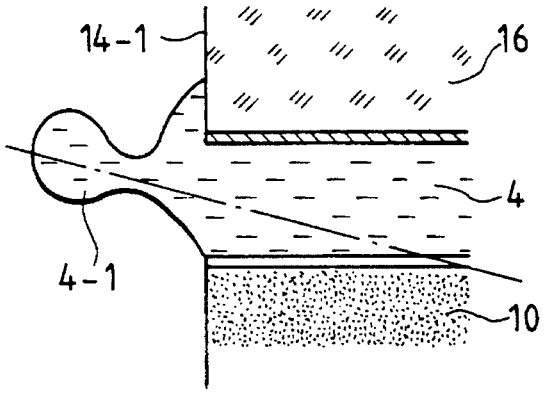
FIG. 2B PRIOR ART

Line 16, "select" should read --selected--.
Line 44, "FIG. 3" should read --FIG. 2--.
Line 65, "squeezee," should read --squeegee,--.

COLUMN 9

Line 45, "Grinding" should read --grinding--.
Line 46, "Grinding" should read --grinding--.

COLUMN 11

Line 45, "Discharge" should read --discharge--.

COLUMN 12

Line 36, "as" should be deleted.
Line 44, "When," should read --When--.

COLUMN 13

Line 26, "omitted;" should read --omitted,-- .

COLUMN 15

Line 7, "example 8" should read --Example 8--.
Line 57, "surface-treating" should read --surface-treating agent--.
Line 60, "an" should read --a--.

UNITED STATES PATENT AND TRADEMARK OFFICE

CERTIFICATE OF CORRECTION

PATENT NO. : 5,581,285

DATED : December 3, 1996

INVENTOR(S) : TAKASHI WATANABE ET AL.

It is certified that error appears in the above-identified patent and that said Letters Patent is hereby corrected as shown below:

COLUMN 16

Line 10, "three-dimension" should read --three-dimensional--.
Line 41, "in" should read --is--.

COLUMN 17

Line 30, "Grinding" should read --grinding--.
Line 44, "an" should read --a--.

COLUMN 18

Line 50, "layer 14 3," should read --layer 14-3,--.

COLUMN 19

Line 62, "recording" should read --jet recording--.

COLUMN 20

Line 55, "Jet" should read --jet--.

COLUMN 21

Line 9, "squazee" should read --squeegee--.
Line 27, "found-that" should read --found that--.
Line 32, "comparison" should read --a comparison--.

UNITED STATES PATENT AND TRADEMARK OFFICE

CERTIFICATE OF CORRECTION

PATENT NO. : 5,581,285

DATED : December 3, 1996

INVENTOR(S) : TAKASHI WATANABE ET AL.

It is certified that error appears in the above-identified patent and that said Letters Patent is hereby corrected as shown below:

COLUMN 22

Line 2, "was" should read --were--.
Line 36, "Example 16" should read --Examples 16--.

COLUMN 24

Line 1, "Example 18." should read --Example 16.--.
Line 3, "sample 14" should read --sample 14,--.
Line 50, "photo,sensitive" should read --photosensitive--.
Line 56, "potosensitive" should read --photosensitive--.
Line 59, "(subs/rate" should read --(substrate--.

COLUMN 25

Line 35, "comparison-with" should read --a comparison with--.

COLUMN 26

Line 2, "dried, after" should read --dried. After--.
Line 10, "and respectively" should read --and 18, respectively--.
Line 36, "i.e. sample 19" should read --i.e., sample 19,--.

UNITED STATES PATENT AND TRADEMARK OFFICE

CERTIFICATE OF CORRECTION

PATENT NO. : 5,581,285

DATED : December 3, 1996

INVENTOR(S) : TAKASHI WATANABE ET AL.

It is certified that error appears in the above-identified patent and that said Letters Patent is hereby corrected as shown below:

COLUMN 27

Line 24, "elastower" should read --elastomer--.
Line 33, "an" should read --a--.
Line 51, "tramsferring" should read --transferring--.
Line 58, "concane" should read --concave--.

COLUMN 28

Line 6, "securety" should read --securely--.
Line 7, "pheirpheral" should read --peripheral--.
Line 20, "3μm,but" should read --3μm, but--.
Line 38, "pich C" should read --pitch C--.
Line 44, "show" should read --shown--.
Line 64, "suport" should read --support--.
Line 65, "plage" should read --plate--.

COLUMN 29

Line 2, "foom" should read --from--.
Line 3, "squeezee" should read --squeegee-- and "con/act" should read --contact--.
Line 5, "porton" should read --portion--.

UNITED STATES PATENT AND TRADEMARK OFFICE

CERTIFICATE OF CORRECTION

PATENT NO. : 5,581,285

DATED : December 3, 1996

INVENTOR(S) : TAKASHI WATANABE ET AL.

It is certified that error appears in the above-identified patent and that said Letters Patent is hereby corrected as shown below:

COLUMN 30

Line 3, "bounded" should read --bonded--.
Line 12, "potog-" should read --photog- --.
Line 13, "comvex" should read --convex--.
Line 31, "(sample" should read --(sample 20).--.
Line 53, "sample 25" should read --sample 25:--.
Line 59, "Jet" should read --jet--.

COLUMN 31

Line 28, "Predetermined" should read --predetermined--.
Line 53, "an" should read --a--.

COLUMN 33

Line 12, "squeeze" should read --squeegee--.

COLUMN 34

Line 43, "was" (first occurrence) should read --were--.
Line 47, "shown," should read --shown--.

COLUMN 35

Table 9, "surface to" should read --surface--.
Line 41, "mass production" should read --mass-production--.
Line 50, "10.5μm" should read --0.5μm--.
Line 55, well known" should read --well-known--.

UNITED STATES PATENT AND TRADEMARK OFFICE

CERTIFICATE OF CORRECTION

PATENT NO. : 5,581,285

DATED : December 3, 1996

INVENTOR(S) : TAKASHI WATANABE ET AL.

It is certified that error appears in the above-identified patent and that said Letters Patent is hereby corrected as shown below:

COLUMN 36

Line 17, "is" should read --are--.
Line 22, "stable" should read --stably--.
Line 28, "mirror finished" should read --mirror-finished--.
Line 29, "much readily" should read --much more readily--.
Line 34, much simply" should read --much more simply--.
Line 57, "an" should be deleted.

COLUMN 37

Line 17, "so called" should read --so-called--.

Signed and Sealed this

Thirtieth Day of September, 1997

Bruce Lehman

*Attest:*

BRUCE LEHMAN

*Attesting Officer*

*Commissioner of Patents and Trademarks*